US005937767A

United States Patent [19]

Togawa et al.

[11] Patent Number: 5,937,767

[45] Date of Patent: Aug. 17, 1999

[54] PLASTIC PALLET

[75] Inventors: Yoshiaki Togawa; Toshitsugu Kikuchi; Tohru Yabe; Shinichi Nagaoka, all of Ichihara, Japan

[73] Assignee: Sumitomo Chemical Company Limited, Osaka, Japan

[21] Appl. No.: 08/831,497

[22] Filed: Mar. 31, 1997

[30] Foreign Application Priority Data

Mar. 29, 1996 [JP] Japan ..... 8-076004
Jul. 3, 1996 [JP] Japan ..... 8-173642

[51] Int. Cl.[6] ..... B65D 19/38

[52] U.S. Cl. ..... 108/57.26; 108/901

[58] Field of Search ..... 108/51.11, 52.1, 108/901, 57.1, 57.25, 57.26

[56] References Cited

U.S. PATENT DOCUMENTS 3,938,448 2/1976 Nishitani et al. .
4,397,246 8/1983 Ishida et al. .
5,154,872 10/1992 Masui et al. .

FOREIGN PATENT DOCUMENTS 2 301 444 9/1976 France .
2 310 277 12/1976 France .
56-41505 9/1981 Japan .
62-6502 2/1987 Japan .
63-44625 9/1988 Japan .
2-72048 3/1990 Japan .
3-50703 8/1991 Japan .
4-57744 2/1992 Japan .
5-42943 2/1993 Japan .
8-268430 10/1996 Japan .

*Primary Examiner*—Peter R. Brown
*Assistant Examiner*—Gerald A. Anderson
*Attorney, Agent, or Firm*—Pillsbury Madison & Sutro, LLP

[57] ABSTRACT

A plastic pallet comprises a pair of deck boards opposed to each other in parallel with each other, a pair of outer girder portions respectively disposed at a pair of opposite side portions of the deck boards, an inner girder portion placed midway between the outer girder portions, and a plurality of reinforcement ribs disposed on respective inner surfaces of said deck boards. Each of the outer girder portions includes a side wall and a first partition wall disposed between the deck boards. The inner girder portion includes a pair of second partition walls which are disposed in parallel with each other with a predetermined distance. The reinforcement ribs existing within a range of a distance extending inward and outward from the first partition wall have a total weight greater than the total weight of the reinforcement ribs existing within a range of the distance extending outward and inward from the second partition wall. With this arrangement, a region around the partition wall of the outer girder portion to be particularly reinforced can be effectively reinforced without wastefully increasing the weight of the pallet.

33 Claims, 15 Drawing Sheets

PLASTIC PALLET

BACKGROUND OF THE INVENTION

1. Field of the Invention

The present invention relates to a plastic pallet which is used when objects are transferred by means of a forklift or the like.

2. Related Background Art

Pallets are used for transfer, storage, and the like of objects. Though they had been made of wood in general, recently they have often been made of plastic in order to reduce their weight.

Due to the strength characteristics of the material itself, however, plastic pallets tend to have a bending strength lower than that of the conventional wooden pallets. In particular, in cases where a fork of a forklift is inserted into a plastic pallet in order to move a load, especially when the load is heavy, not only a deck board but also the whole pallet may deform flexibly, thereby causing a load shift. Accordingly, as disclosed in Japanese Patent Application Laid-Open No. 2-72048, it has been proposed to change the interval or thickness of reinforcement ribs which are monolithically formed with the deck board in order to reinforce the deck board.

Though the bending strength of the pallet disclosed in the above-mentioned publication is increased due to the reinforcement effected by the ribs, the total weight of the pallet is so heavy that the bending strength per weight, i.e., specific strength, is decreased.

SUMMARY OF THE INVENTION

The present inventors have found that the above-mentioned tendency of the prior art results from the fact that superfluous ribs are also provided at a portion of the pallet which is not substantially contributory to its bending strength.

Thus, it is an object of the present invention to provide an improved pallet which realizes a lighter weight and higher strength.

A plastic pallet of the present invention comprises: a pair of deck boards opposed to each other in parallel with each other; a pair of outer girder portions respectively disposed at a pair of opposite side portions of the deck boards between the deck boards, each of the outer girder portions including a side wall disposed between associated side edges of the deck boards and a first partition wall disposed between the deck boards so as to oppose to the side wall in parallel therewith with a predetermined distance therebetween; an inner girder portion disposed between the deck boards so as to be placed midway between the outer girder portions, the inner girder portion including a pair of second partition walls which are disposed in parallel with each other with a predetermined distance therebetween and in parallel with the first partition wall; and a plurality of reinforcement ribs disposed on respective inner surfaces of the deck boards; wherein the reinforcement ribs existing in a first region in which the first partition wall is located have a total weight greater than the total weight of the reinforcement ribs existing in a second region in which the associated second partition wall is located, the first and second regions extending in parallel with the side walls and having the same width. Further, the first and second regions are symmetrical with each other in relation of a center axis extending between the first and second partition walls.

As the result of this arrangement, the first partition wall and peripheral portions of the deck boards adjacent to the first partition wall are reinforced more than the second partition wall and peripheral portions of the deck boards adjacent to the second partition wall such that the flexural strength od the pallet is increased as a whole.

The first region may be defined by the first partition wall and a plane provided in parallel with the first partition wall and spaced inward from the first partition wall with a first distance, and the second region may be defined by the second partition wall and a plane provided in parallel with the second partition wall and spaced outward from the second partition wall with the first distance.

Alternatively, the first region may be defined by the first partition wall and a plane provided in parallel with the first partition wall and spaced outward from the first partition wall with a second distance, and the second region may be defined by the second partition wall and a plane provided in parallel with the second partition wall and spaced inward from the second partition wall with the second distance.

Further, the first region may be defined by a plane provided in parallel with the first partition wall and spaced inward from the first partition wall with a first distance and a plane provided in parallel with the first partition wall and spaced outward from the first partition wall with a second distance, and the second region may be defined by a plane provided in parallel with the second partition wall and spaced outward from the second partition wall with the first distance and a plane provided in parallel with the second partition wall and spaced inward from the second partition wall with the second distance.

In a preferred embodiment of the present invention, the first distance is approximately ⅓ of the distance between the first partition wall and the second partition wall opposed thereto. The second distance is approximately ⅓ of the shorter of the distance between the side wall of the outer girder portion and the first partition wall and the distance between the pair of second partition walls of the inner girder portion.

The reinforcement ribs include a plurality of longitudinal ribs extending in parallel with the side wall and a plurality of transverse ribs extending orthogonally to the longitudinal ribs. In this case, the transverse ribs disposed between the inner girder portion and the outer girder portions may have a greater thickness in a region adjacent to the first partition wall than in the other region. Alternatively, the transverse ribs disposed between the inner girder portion and the outer girder portions may have a greater height in a region adjacent to said first partition wall than in the other region. Further, a greater number of the transverse ribs may be disposed in a region adjacent to the first partition wall than in the other region.

It is preferred that the plastic pallet further comprises a nonslip member provided on an outer surface of at least one of the deck boards. The nonslip member may be made of a non-crosslinking thermoplastic elastomer composition containing 30 to 90 parts by weight of an ethylene-α-olefin copolymer rubber and 70 to 10 parts by weight of a polyolefin resin.

Preferably, the plastic pallet further comprises a plurality of linear projections monolithically formed on an outer surface of at least one of the deck boards.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DETAILED DESCRIPTION OF THE PREFERRED EMBODIMENTS

In the following explanations and drawings, parts identical or equivalent to each other will be referred to with numerals identical to each other. Also, for clarification, suffixes are added to the reference marks when appropriate.

Figure 1:
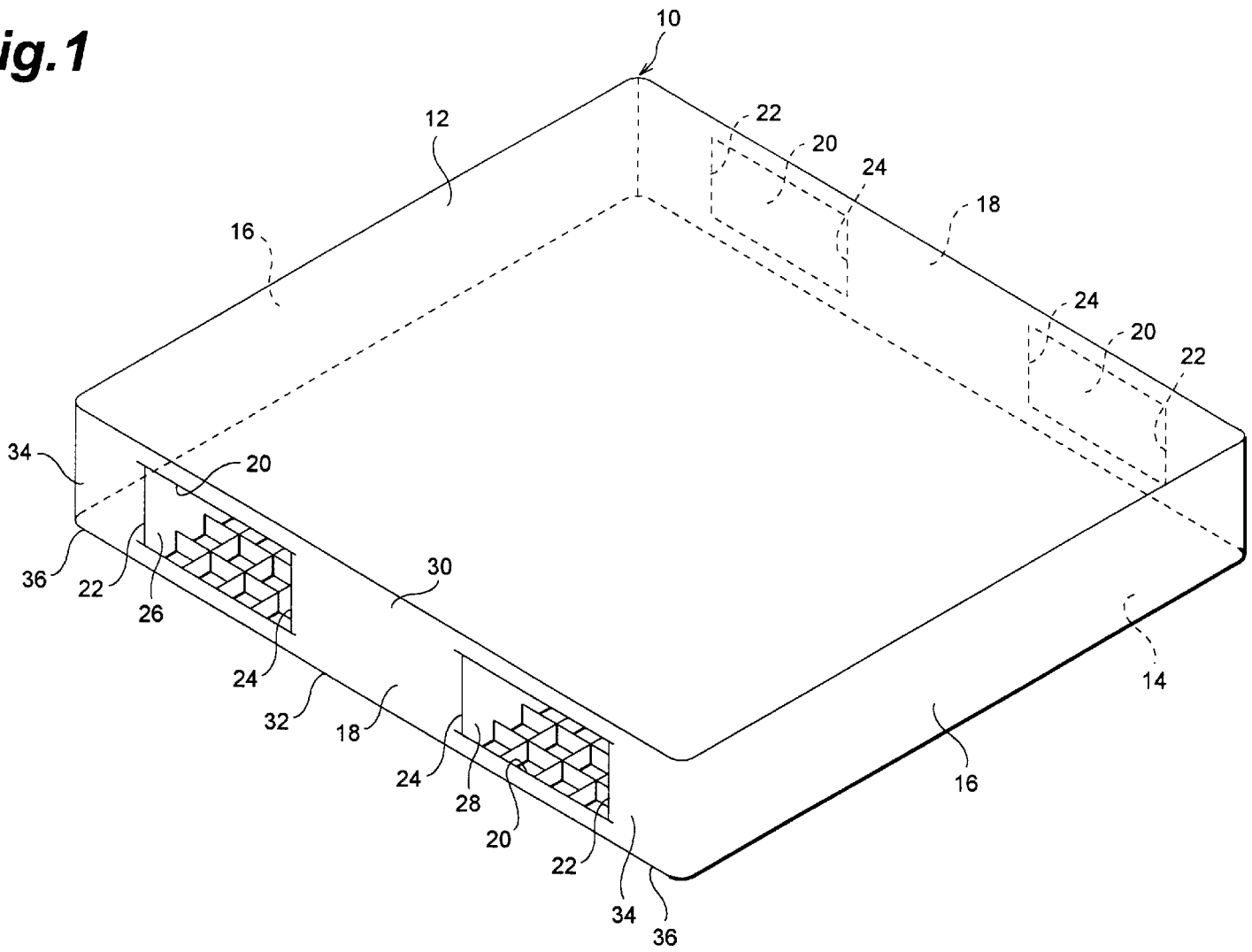
FIG. 1 is a perspective view showing a pallet in accordance with a first embodiment of the present invention.

Referring now to the drawings, and particularly to FIG. 1, there is shown a plastic pallet according to the present invention, generally designated by the numeral 10. This pallet 10 is formed as a substantially square plate, and as a one-piece structure or monolith. The pallet 10 comprises a pair of substantially parallel planar deck boards 12 and 14 substantially in parallel. These deck boards 12 and 14 are generally square and are configured substantially identical to each other. Though the outer surfaces of both of the deck boards 12 and 14 can serve as a surface for carrying objects, it is assumed in the following explanation that only the upper surface of the upper deck board 12 in FIG. 1 functions as a carrier surface. Here, for clarification, the upper deck board 12 and the lower deck board 14 in FIG. 1 are referred to as "upper board" and "lower board," respectively.

The upper board 12 and lower board 14 are connected to each other by side walls or side girders 16 and 18 which are disposed therebetween and extend along edges of the upper board 12 and lower board 14. Each of the pair of opposed side walls 16 is continuous without bores, openings, and the like. Each of the remaining pair of side walls 18 has two substantially rectangular openings 20 which are disposed symmetrically to each other with respect to the center of the side wall 18. These openings 20 function to receive a fork of a forklift (not depicted) when the pallet 10 is used for transferring objects. From portions 22 and 24 of the side wall 18 which define the respective side edges of the fork-inserting opening 20, partition walls or partition girders 26 and 28 respectively extend to their corresponding portions 22 and 24 of the opposed side wall 18. The upper and lower edges of the partition walls 26 and 28 respectively join with the upper board 12 and lower board 14. It is preferred that the corner portions 22 and 24 between the side walls 18 and partition walls 26 and 28 are rounded such that the fork can be easily inserted into the openings 20. For the same purpose, the upper and lower edge portions which define the upper and lower edges of the opening 20 may be rounded or beveled. In the following, a part constituted by center regions 30 between the openings 20, 20 in the respective side walls 18 and the partition walls 28 is referred to as an inner girder portion 32. Also, parts constituted by outer areas 34 in the side walls 18 and their corresponding partition walls 26 and side walls 16 are referred to as outer girder portions 36.

In this pallet 10, as shown in FIGS. 2 to 5, ribs for reinforcing the pallet are monolithically formed on the lower surface of the upper board 12 and the upper surface of the lower board 14. The ribs are planar and include longitudinal ribs 40 extending parallel with the side walls 16 and transverse ribs 42 extending parallel with the side walls 18. These ribs 40 and 42 extend perpendicularly to the upper board 12 and lower board 14 so that they can support vertical loads acting thereon from the upper board 12.

In this embodiment, all of the ribs 40 and 42 in the outer girder portions 36 and inner girder portion 32 continuously extend from the upper board 12 to the lower board 14. However, a part of the ribs may extend discontinuously.

Between the inner girder portion 32 and each outer girder portion 36, a predetermined space is provided between the ribs 40 and 42 formed on the lower surface of the upper board 12 and those formed on the upper surface of the lower board 14. This space substantially equals to the width or height of each fork-inserting opening 20 formed in the side walls 18. Accordingly, spaces defined by the opposed partition walls 26 and 28, the lower edge of the upper ribs 40 and 42, and the upper edge of the lower ribs 40 and 42 become fork-inserting holes 44 into which the fork can be inserted.

More specifically, longitudinal ribs 40*a* in the inner girder portion 32 are equidistantly disposed in parallel with each other so as to continuously extend between the side walls 18, 18. Transverse ribs 42*a* in the inner girder portion 32 are equidistantly disposed in parallel with each other so as to continuously extend between the partition walls 28, 28.

Also, longitudinal ribs 40*b* placed between the inner girder portion 32 and each outer girder portion 36 are equidistantly disposed parallel with each other so as to continuously extend between the side walls 18, 18. The transverse ribs 42 placed between the inner girder portion 32 and each outer girder portion 36 are equidistantly disposed in parallel with each other so as to continuously extend between their corresponding partition walls 26 and 28. The transverse ribs 42 in this region are constituted by main ribs 42*b* and sub ribs 42*c*. Each main rib 42*b* extends as an extension of the transverse rib 42*a* in the inner girder portion 32. Each sub rib 42*c* is disposed midway between the neighboring main ribs 42*b*, 42*b*.

Longitudinal ribs 40*c* in the outer girder portions 36 continuously extend between the side walls 18, 18 and are preferably disposed near their corresponding partition walls 26. The transverse ribs 42 in each outer girder portion 36 are constituted by main ribs 42*d* and sub ribs 42*e*. Each main rib 42*d* continuously extends from the corresponding partition wall 26 to the side wall 16 as an extension of the main rib 42*b* disposed between the inner girder portion 32 and outer girder potion 36. Each sub rib 42*e* continuously extends from the corresponding partition wall 26 to the longitudinal rib 40*c* as an extension of the sub rib 42*c* disposed between the inner girder portion 32 and outer girder portion 36.

Further, between the inner girder portion 32 and each outer girder portion 36, the transverse ribs 42*b* and 42*c* positioned in a region $S_1$ between the partition wall 26 of the outer girder portion 36 and its adjacent longitudinal rib $\mathbf{40}b_1$ are made thicker than the transverse ribs 42*b* and 42*c* in the other regions.

The pallet 10 is made of a synthetic resin, preferably, a thermoplastic resin. The synthetic resin may appropriately be selected according to, for example, cost, compatibility with fillers and additives, easiness in molding, use and size of the pallet, mechanical strength required for the pallet (e.g., compressive strength, bending strength, or flexure strength), and various physical properties.

Examples of thermoplastic resin to be used as a preferable material for the pallet 10 include polyethylene resins, polypropylene resins, polyamides, polyethylene terephthalate, acrylonitrile-butadiene-styrene copolymer (ABS), polyvinyl chloride resin, and polycarbonate. Also, their modified products and mixtures as well as polymer alloys and the like can be used.

From the viewpoint of mechanical strength required for the pallet 10, polypropylene resins such as homopolymers of propylene or copolymers made of propylene and other monomers are particularly preferable as its material.

The above-mentioned thermoplastic resins may be used in their non-foamed state as well as being foamed to a volume which is about 1.1 to 1.2 times that of the original volume in order to ameliorate their fluidity or the like. When the thermoplastic resin is used in the formed state, it can still be molded similarly to the non-foamed body, while realizing the pallet with a further smaller weight.

Fillers may be compounded in the above-mentioned thermoplastic resins when necessary. The fillers further improve the mechanical strength of the pallet. It is necessary for the fillers to be stable at the melting point of the thermoplastic resins and have a favorable compatibility with the thermoplastic resins. Examples of fillers include inorganic fibers such as glass fibers and carbon fibers as well as inorganic powders such as talc, clay, silica, and calcium carbonate.

The above-mentioned fillers may appropriately be selected according to, for example, cost, compatibility with the thermoplastic resins, use and size of the pallet, mechanical strength required for the pallet, and various physical properties. Of the above-mentioned fillers, inorganic fibers such as glass fibers in particular are preferable from the viewpoint of the cost and mechanical strength required for the pallet.

Though depending on the kinds of fibers compounded, the length of the above-mentioned inorganic fibers is preferably 0.1 to 50 mm and more preferably 1 to 15 mm. Also, though depending on the kinds of fibers compounded, the diameter of the above-mentioned inorganic fibers is preferably 1 to 50 $\mu$m. The particle size and form of the above-mentioned inorganic powders are not restricted in particular. Though depending on the kinds of fillers compounded, the compounding amount of the fillers with respect to the above-mentioned thermoplastic resins is preferably not more than 50% by weight, more preferably 10% by weight to 40% by weight, and further preferably 15% by weight to 35% by weight from the viewpoint of the mechanical strength required for the pallet. Also, the above-mentioned fillers may be compounded in the thermoplastic resins either separately or in combinations of two or more when necessary. Further, the method of mixing them with the thermoplastic resins is not restricted in particular.

Also, such additives as antioxidants, ultraviolet absorbents, colorants, release agents, and unti-shrinking agents may be added to the thermoplastic resins when necessary.

Figure 2:
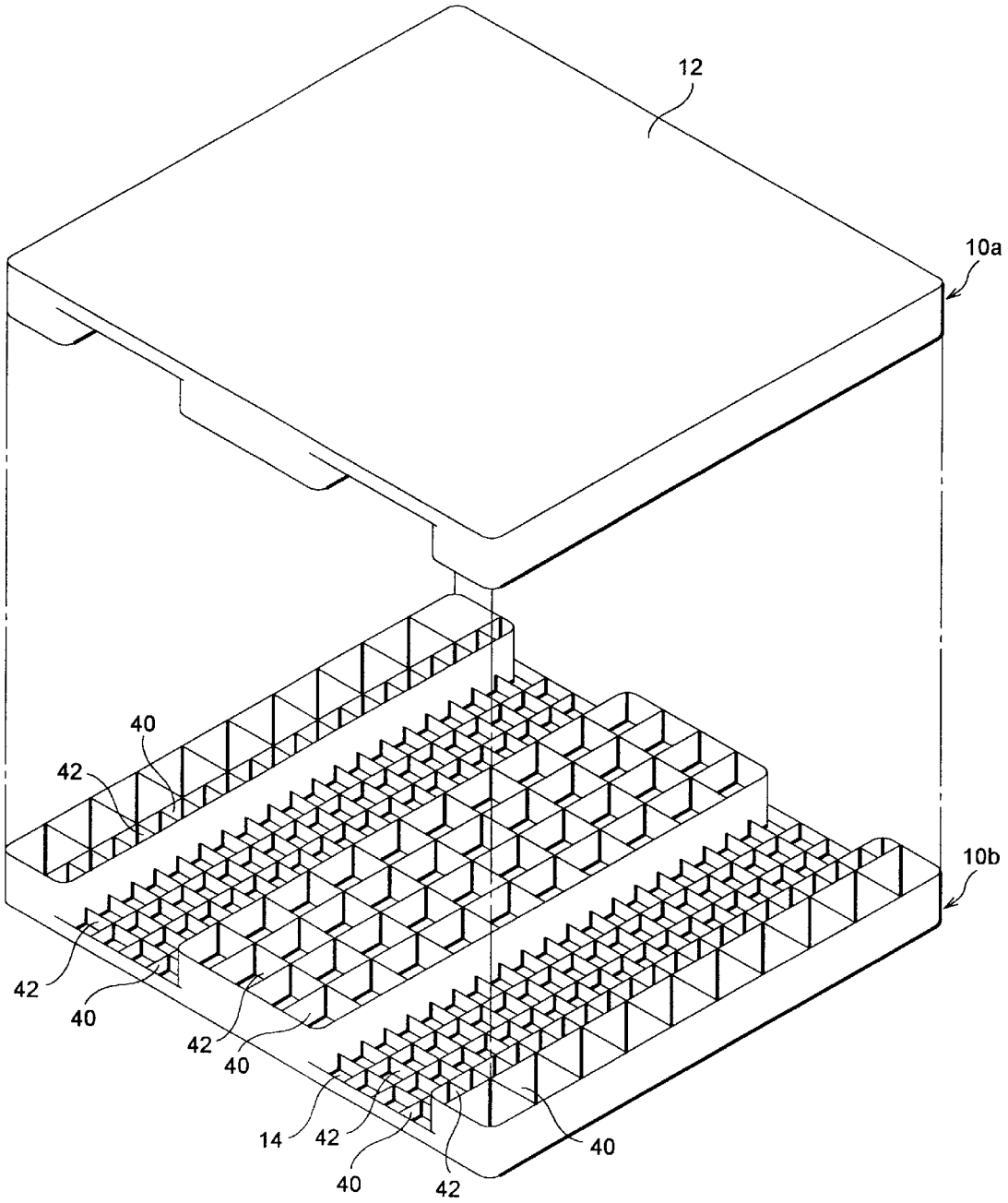
FIG. 2 is an exploded perspective view of the pallet shown in FIG. 1.
Figure 3:
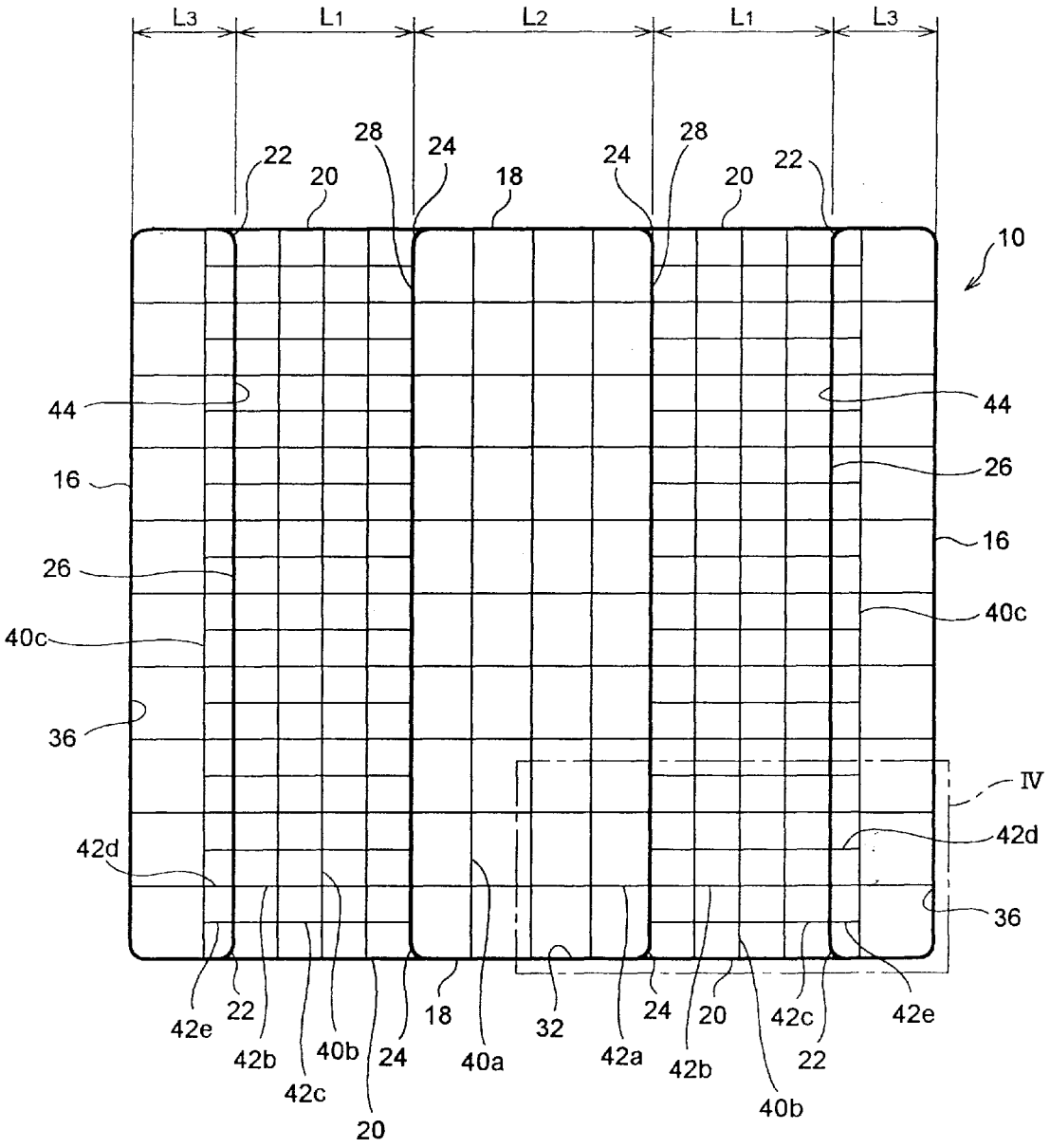
FIG. 3 is an explanatory view showing the arrangement of ribs in the pallet shown in FIG. 1.

In order to make the pallet 10 from a synthetic resin, first, as shown in FIG. 2, an upper half 10*a* including the upper board 12 and a lower half 10*b* including the lower board 14 are molded. These halves 10*a* and 10*b*, which have identical forms, are the same ones as obtained when the pallet 10 shown in FIG. 1 are horizontally divided at its center in the height direction. Though any appropriate method can be used for molding the halves 10*a* and 10*b*, an injection press molding method such as that disclosed in the U.S. Pat. No. 5,154,872 is preferably employed, and the disclosure of this patent is incorporated hereby by reference. As the halves 10*a* and 10*b* are molded, the intersecting portions between their individual constituents are integrated together.

After the upper and lower halves 10*a* and 10*b* are formed, their faces to be joined together are made to abut to each other and then are joined together by means of an appropriate joining method such as heat fusion, whereby the pallet 10 shown in FIG. 1 is formed.

Figure 6:
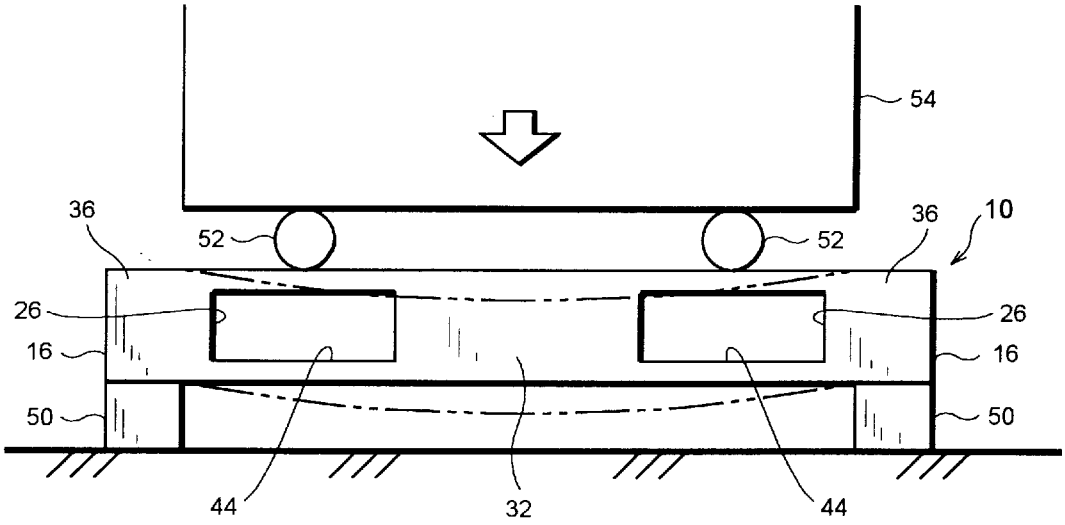
FIG. 6 is an explanatory view showing a method for testing the bending strength of a pallet.

Referring now to FIG. 6, the pallet 10 is mounted on support tables 50 which are disposed in parallel with each other, while a load is imparted to the pallet 10 from thereabove by way of steel round bars 52 disposed on the pallet 10 along the longitudinal axial lines of the respective fork-inserting holes 44. In this case, the pallet sags as indicated by two-dot chain lines in FIG. 6. Here, it bends most greatly at the peripheral portions of the partition walls 26 of the outer girder portions 36.

In this embodiment, however, since the peripheral portions of the partition walls 26 in the outer girder portions 36 are locally reinforced, the load is dispersed, thereby reducing the amount of flexure. Accordingly, less stress occurs. Namely, the main transverse ribs 42*a*, 42*b*, and 42*d* continuously extend between the side walls 16, 16, while the sub transverse ribs 42*c* and 42*e* project into the outer girder portion 36 from the partition walls 28 of the inner girder portion 32 through the partition walls 26 of the outer girder portions 36. Accordingly, the region between the inner girder portion 32 and each outer girder portion 36, i.e., region of each fork-inserting hole 44, is reinforced, and further the peripheral portions of the partition walls 26 in the outer girder portions 36 are reinforced. In addition, since one end of each sub rib 42*e* in the outer girder portion 36 is connected to the longitudinal rib 40*c*, the force acting on the sub ribs 42*e* can be dispersed from the longitudinal rib 40*c* into the main ribs 42*d*. Also, since the transverse ribs 42*b* and 42*c* in the region $S_1$ adjacent to the outer girder portions 36 are made thicker than those in the other regions, the partition walls 26 and the peripheral portions of the upper and lower boards 12, 14 adjacent to the partition walls 26 are sufficiently reinforced.

Figure 4:
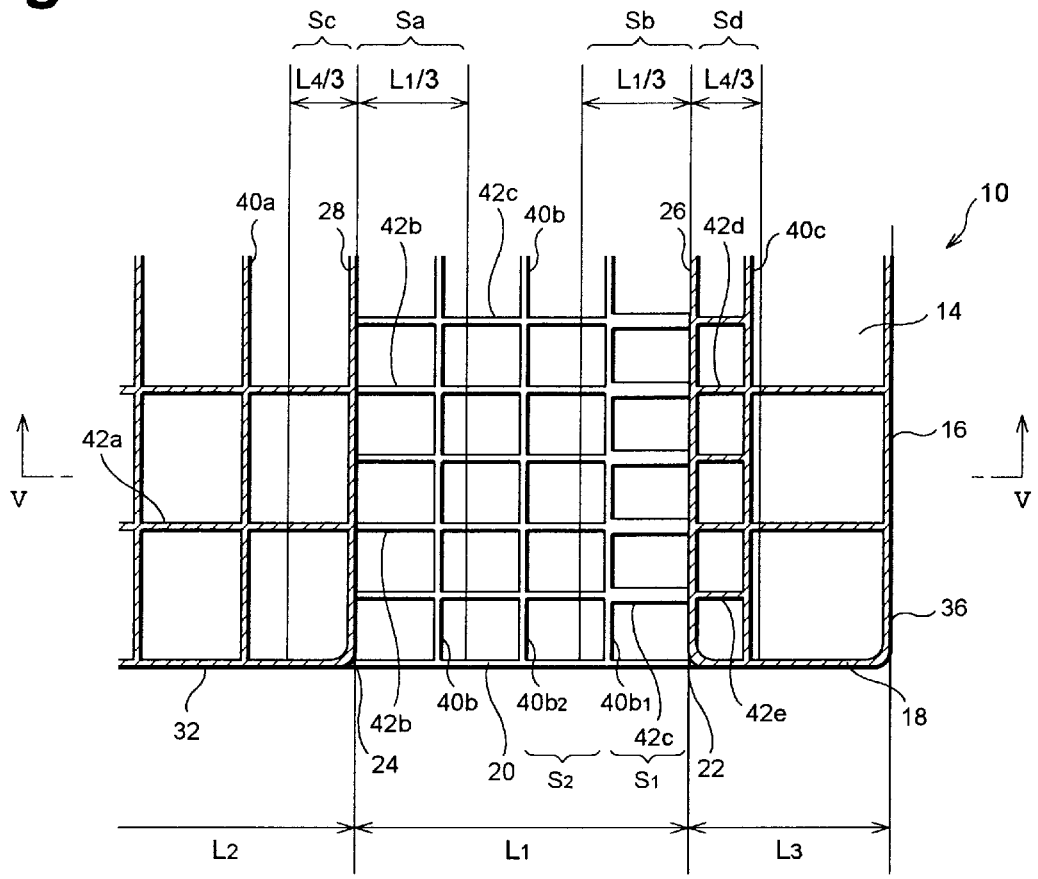
FIG. 4 is an enlarged cross-sectional view of part IV shown in FIG. 3, taken along IV—IV line in FIG. 5.
Figure 5:
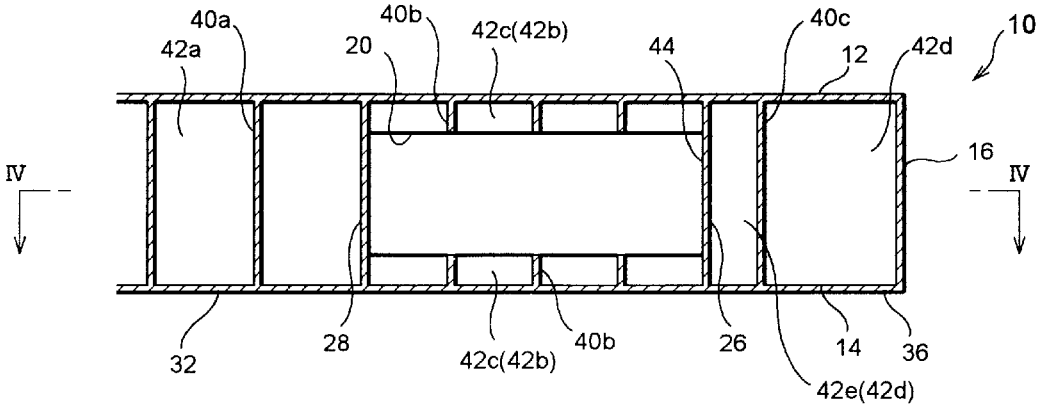
FIG. 5 is a cross-sectional view taken along V—V line in FIG. 4.

In the following, the configurations of the reinforcement ribs 40 and 42 will be explained in terms of weight. In FIG. 4, a region designated by "Sa" is defined by each partition wall 28 of the inner girder portion 32 and a plane provided in parallel with the partition wall 26 and spaced outward from the wall 26 with a predetermined distance or width, and a region designated by "Sb" is defined by the partition wall 26 of opposed outer girder portion 36 and a plane provided in parallel with the partition wall 26 and spaced inward from the wall 26 with the same distance. When the reinforcement ribs 40 and 42 in the region Sa and those in the region Sb are compared with each other in terms of weight, the latter reinforcement ribs are heavier than the former reinforcement ribs since the thickness of the transverse ribs 42 in the region $S_1$ adjacent to the partition wall 26 is made greater. Namely, the ratio of the total weight of the reinforcement ribs in the region Sb to the total weight of the reinforcement ribs in the region Sa exceeds 1. Here, it is preferred that the distance defining the regions Sa and Sb be approximately ⅓ of the width, i.e., horizontal length $L_1$, of the fork-inserting opening 20. It is due to the fact that, of the reinforcement ribs 40 and 42, only those existing within this range of distance contribute to the reinforcement of the peripheral portion of the partition wall 26 in each outer girder portion 36.

Also, in FIG. 4, a region designated by "Sc" is defined by each partition wall 28 of the inner girder portion 32 and a plane provided in parallel with the partition wall 26 and spaced inward from the wall 26 with a predetermined distance or width, and a region designated by "Sd" is defined by the partition wall 26 of opposed outer girder portion 36 and a plane provided in parallel with the partition wall 26 and spaced outward from the wall 26 with the same distance. When the reinforcement ribs 40 and 42 in the region Sc and those in the region Sd are compared with each other in terms of weight, the latter reinforcement ribs are heavier than the former reinforcement ribs since due to the existence of the reinforcement ribs 40*c*, 42*e*. Namely, the ratio of the total weight of the reinforcement ribs in the region Sd to the total weight of the reinforcement ribs in the region Sc exceeds 1. Here, assuming that the width of the inner girder portion 32 is $L_2$, that the width of each outer girder portion 36 is $L_3$, and that the smaller of these widths is $L_4$, it is preferred that the width defining the regions Sc and Sd be approximately ⅓ of $L_4$. The width is set to approximately $L_4/3$ since, of the reinforcement ribs 40 and 42, only those existing within this range contribute to the reinforcement of the peripheral portion of the partition wall 26 in each outer girder portion 36. Also, the smaller width of $L_2$ and $L_3$ is selected since, assuming that there is a relationship of $L_2<L_3$ and that $L_3$ is adopted as $L_4$, the region Sc defined by $L_4/3$ may occupy most part of the inner girder portion 32 and, according to circumstances, may exceed the inner girder portion 32.

Thus, since the reinforcement ribs are made of the same material, the fact that the reinforcement ribs in the regions Sb and Sd are heavier than those in the regions Sa and Sc means that the total cross-sectional area of the reinforcement ribs in the regions Sb and Sd is greater than that of the reinforcement ribs in the regions Sa and Sc. As compared with reinforcement ribs having a smaller cross-sectional area, a smaller force acts per unit area on those having a greater cross-sectional area, thereby generating a smaller internal stress. This can enhance the reinforcing effect.

Thus, when the total weight of the reinforcement ribs is increased in the regions to be reinforced in particular, a desired reinforcing effect is obtained. Accordingly, since it is not necessary for the other parts to be provided with additional reinforcement ribs or larger reinforcement ribs, the weight of the pallet can be maintained or reduced, while a higher strength is obtained. Here, it is preferred that each of the ratio of the total weight of the reinforcement ribs in the region Sb to that of the reinforcement ribs in the region Sa and the ratio of the total weight of the reinforcement ribs in the region Sd to that of the reinforcement ribs in the region Sc is not greater than 5. The weight of the pallet may increase to an undesirable extent when the weight ratio exceeds 5.

As can be appreciated from the foregoing, means for increasing the total weight of the reinforcement ribs, such as the transverse ribs 42 in particular, around the partition walls 26 of the outer girder portions 36 is not restricted to the embodiment shown in FIGS. 1 to 5. For example, each of the transverse ribs 42*b* and 42*c* in the region referred to with the mark $S_2$ in FIG. 4 may have a thickness identical to the thickness of each transverse rib in the region $S_1$.

Figure 7:
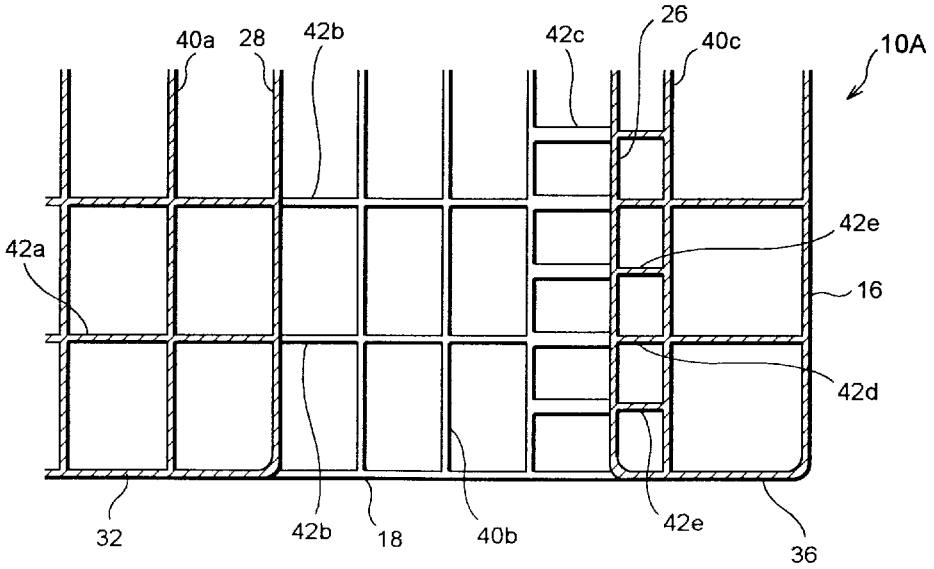
FIG. 7 is a cross-sectional view similar to FIG. 4, showing a modified example of the pallet in accordance with the present invention.

Alternatively, as shown in FIG. 7, the sub reinforcement ribs 42*c* and 42*e* may be disposed only around the partition wall 26 of the outer girder portion 36, whereas the other regions are provided with no sub reinforcement ribs. A pallet 10A shown in FIG. 7 has a further reduced weight of its own as compared with the pallet 10, while yielding the similar reinforcing effects.

Figure 8:
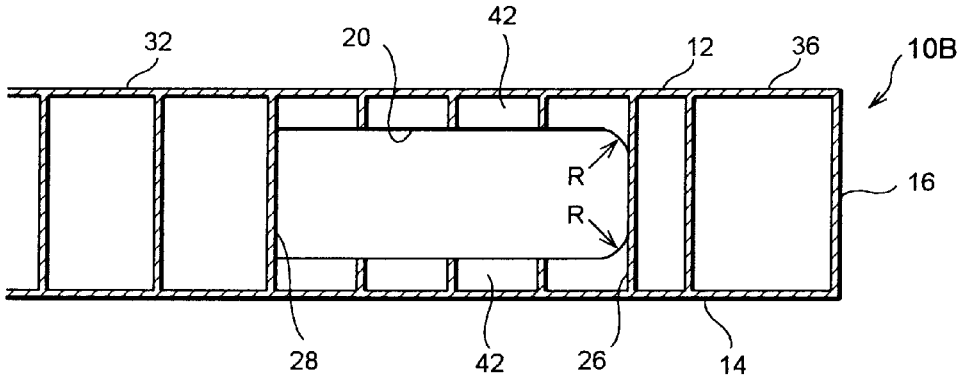
FIG. 8 is a cross-sectional view similar to FIG. 5, showing another modified example of the pallet in accordance with the present invention.

Further, as shown in FIG. 8, the transverse ribs 42*b* between the inner girder portion 32 and each outer girder portion 36 may increase their height as they approach the partition wall 26 of the outer girder portion 36. In this case, it is preferred that the edge of the portion where the height of each transverse rib 42 changes be provided with a radius R of a degree which does not make it difficult for a fork to be inserted therein. In a pallet 10B shown in FIG. 8, portions of the rib reinforcing the partition wall 26 are vertically extended, whereby the partition wall 26 of the outer girder portion 36 which receives a bending moment when a load is imparted to the pallet 10B can be effectively reinforced.

Figure 9:
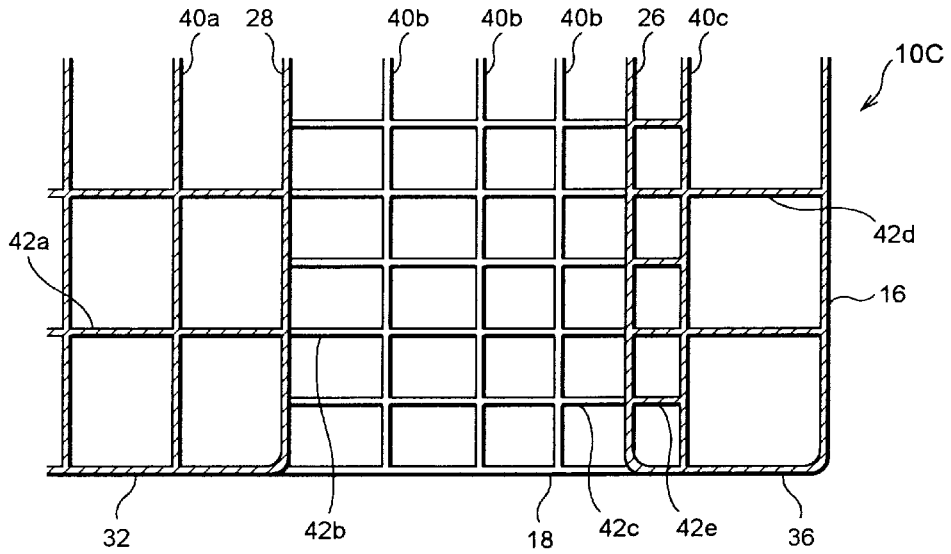
FIG. 9 is a cross-sectional view similar to FIG. 4, showing a different modified example of the pallet in accordance with the present invention.

Further, as shown in FIG. 9, the distance between the neighboring longitudinal ribs 40*b* interposed between the inner girder portion 32 and the outer girder portion 36 may decrease from the inner girder portion 32 toward the outer girder portion 36. In the pallet 10C shown in FIG. 9, the arrangement of the ribs can locally reinforce the peripheral portion of the partition wall 26 of the outer girder portion 36 in the pallet 10C as well.

Figure 25:
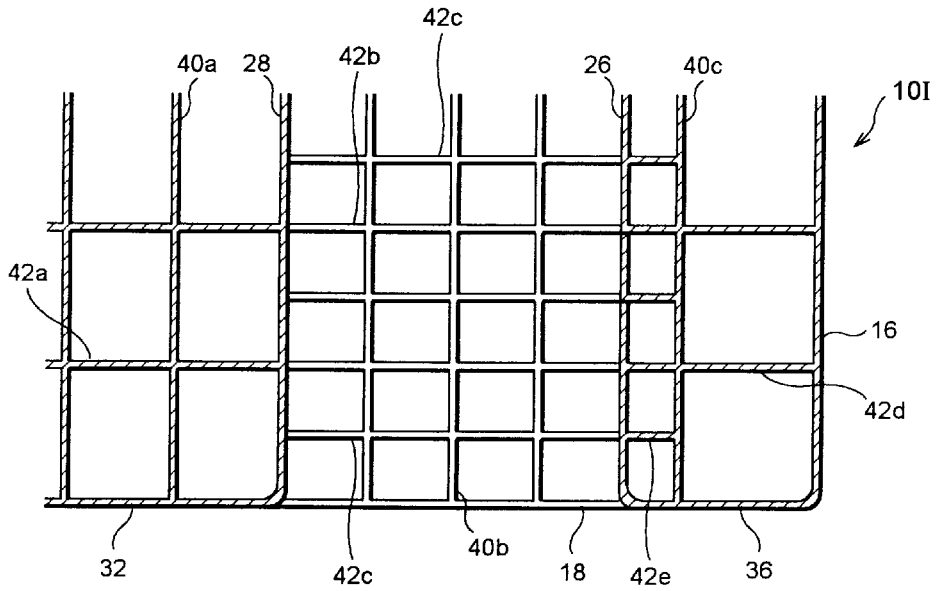
FIG. 25 is a cross-sectional view similar to FIG. 4, showing another modified example of the pallet in accordance with the present invention.

It will be apparent that various changes may be in the form, construction and arrangement of the above-mentioned pallets. For example, a pallet 10I of the present invention shown in FIG. 25 has the substantially same configuration as the pallet 10 shown in FIGS. 1 to 5, except that each transverse rib 42*b*, 42*c* between the inner girder portion 32 and the outer girder portion 36 has a constant thickness throughout its length. In this configuration, the partition wall 26 of the outer girder portion 36 and the portions of the upper and lower boards 12, 14 adjacent to the wall 26 are sufficiently reinforced due to the presence of the ribs 40*c*, 42*d* and 42*e* in the outer girder portion 36.

Figure 26:
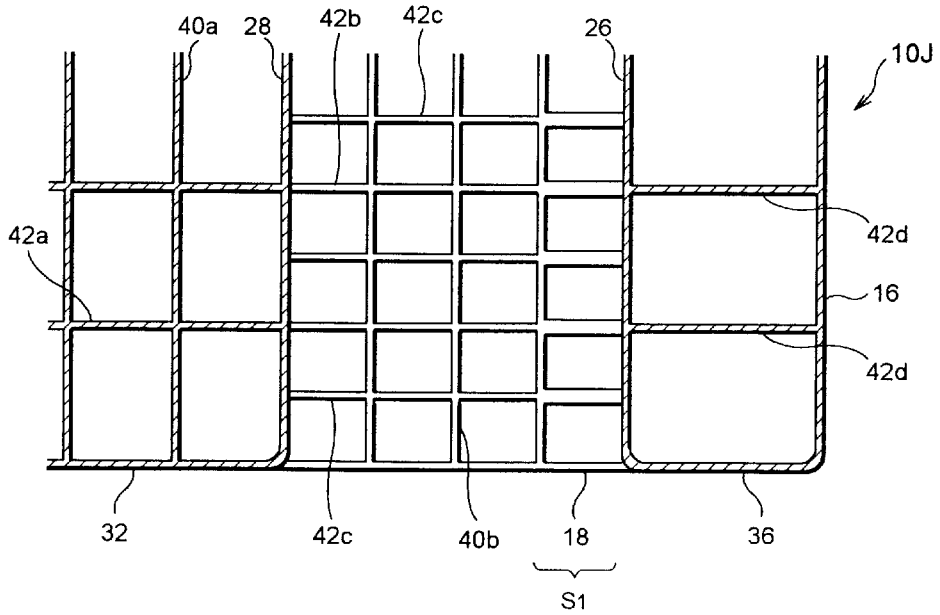
FIG. 26 is a cross-sectional view similar to FIG. 4, showing a further modified example of the pallet in accordance with the present invention.

Also, FIG. 26 shows another embodiment of the present invention. Though a pallet 10J shown in FIG. 26 has the substantially same configuration as the pallet 10 shown in FIGS. 1 to 5, the pallet 10J differs from the pallet 10 in that there are the only main ribs 42*d* in the outer girder portion 36 without the sub ribs 42*e* and the longitudinal rib 40*c*. In this pallet 10J, since the transverse ribs 42*b* and 42*c* in the region $S_1$ are made thicker than those in the other regions, the partition wall 26 of the outer girder portion 36 and the portions of the upper and lower boards 12, 14 adjacent to the wall 26 are sufficiently reinforced.

In accordance with the present invention, as explained in detail in the foregoing, in place of the simple, uniform arrangement of reinforcement ribs, the degree of reinforcement in the peripheral portions of the partition walls 26 is made higher than that in the peripheral portions of the partition wall 28, whereby the peripheral portions of the partition wall 26 of the outer girder portion 36 on which stress has conventionally tended to concentrate can be effectively reinforced. Consequently, the stress occurring there can be decreased, whereby not only the upper and lower boards 12 and 14 near the above-mentioned peripheral portion but also the whole pallet can be restrained from deforming. The thickness of hte ribs, side walls, partition walls and deck boards is not particularly limited and variable depending on the size of the pallet or the like. For example, in a pallet of 1100 mm width and 1100 mm length which has been widely used, a strength necessary for the pallet can be maintained, while the reinforcement ribs, side walls 16 and 18, and partition walls 26 and 28 each have a thickness as small as about 2 to about 10 mm and the upper board 12, and lower board 14 each have a thickness as small as about 2.5 to about 4.5 mm so as to yield a lighter weight.

Figure 10:
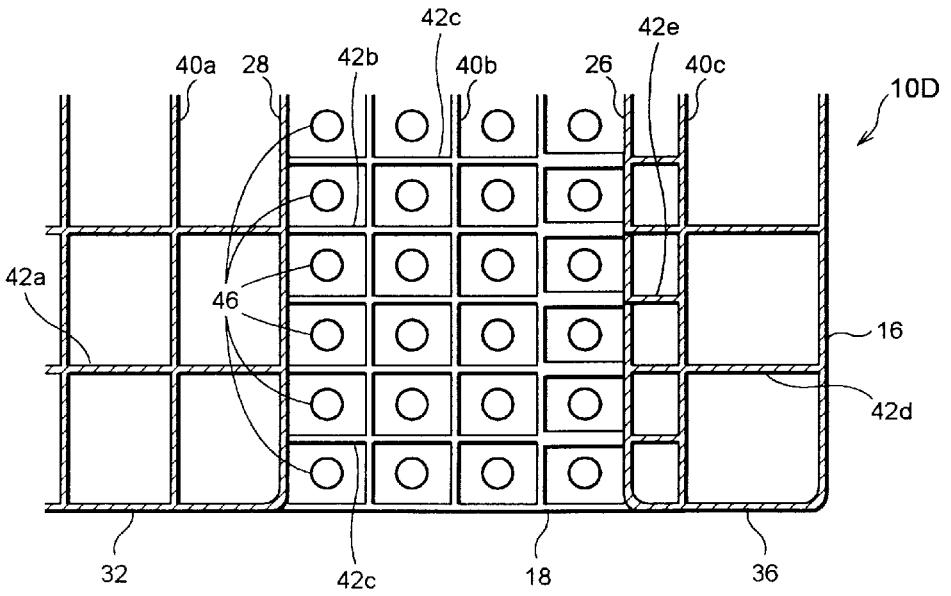
FIG. 10 is a cross-sectional view similar to FIG. 4, showing a further modified example of the pallet in accordance with the present invention.

Here, as in the case of a pallet 10D shown in FIG. 10, it is preferred that the upper and lower boards 12 and 14 in the region between the inner girder portion 32 and outer girder portion 36 be provided with a plurality of drain holes 46. Preferably, at least one drain hole 46 is disposed in each section defined by the reinforcement ribs 40 and 42 such that water is rapidly discharged therefrom. Here, in view of the draining capacity thereof and the strength of the pallet, the drain holes 46 are preferably formed with a total area expressed by an opening ratio of 5% to 20% or, more preferably, 7% to 10% with respect to the area of the upper and lower board 12 and 14 in the region between the inner girder portion 32 and outer girder portion 36.

Figure 11:
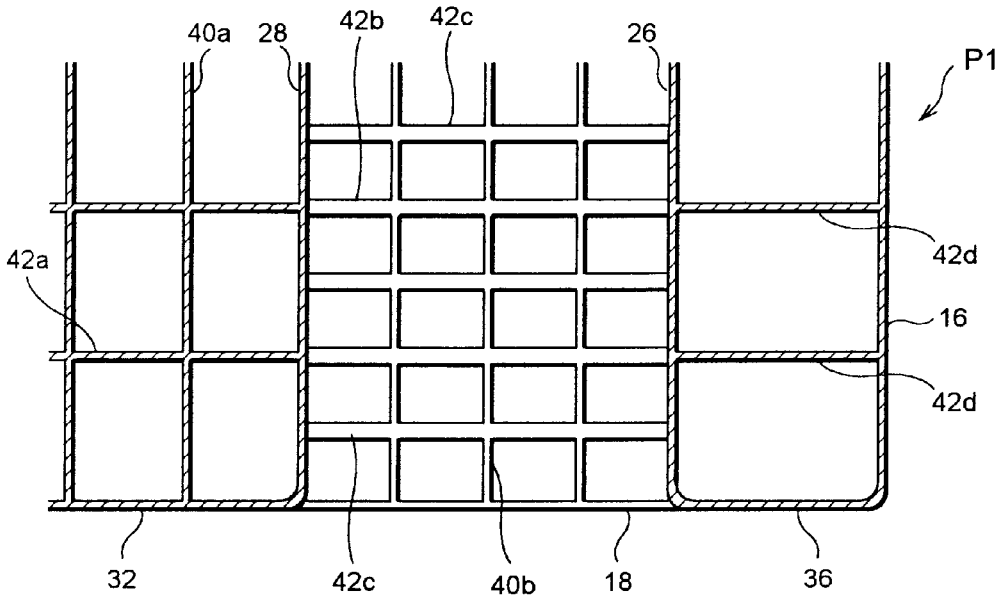
FIG. 11 is a cross-sectional view similar to FIG. 4, showing a comparative pallet.

In the following, the results of the actually measured bending strengths and weights of various pallets will be explained. The pallets used for the measurement were the pallets 10, 10D and 10I having forms shown in FIGS. 1 to 5, FIG. 10 and FIG. 25, respectively. A pallet P1 shown in FIG. 11 was particularly made for comparison.

In order to prepare these pallets, halves were made from polypropylene resin, and then the halves were joined together by heat fusion. Each of these pallets had an outer size defined by a length of 1,100 mm, width of 1,100 mm, and height of 144 mm. The width ($L_1$) of the fork-inserting opening 20 was 260 mm, while the height thereof was 74 mm. The width ($L_2$) of the inner girder portion 32 was 300 mm, whereas the width ($L_3$) of each outer girder portion 36 was 140 mm. Also, the thickness of each of the upper board 12, lower board 14, side walls 16 and 18, and partition walls 26 and 28 was 3 mm. Further, the thickness of each of the reinforcement ribs 40 and 42 in the inner girder portion 32 and outer girder portions 36 was 2.5 mm. These sizes were common in all the measured pallets.

In the pallet 10 shown in FIGS. 1 to 5, the thickness of each of the transverse ribs 42*b* and 42*c* disposed between the inner girder portion 32 and each outer girder portion 36 was 4 mm and 3 mm respectively in the region $S_1$ and the other regions. The longitudinal rib 40*b* had a thickness of 3 mm. The pallet 10D shown in FIG. 10 was the same as the pallet 10 shown in FIGS. 1 to 5 except that it had the drain holes 46 with a diameter of 20 mm. The pallet 10I shown in FIG. 25 was the same as the pallet 10 shown in FIGS. 1 to 5 except that the transverse ribs 42*b* and 42*c* had a constant thickness of 3 mm. In the pallet P1 shown in FIG. 11, only the main ribs 42*d* of the transverse ribs were disposed in the outer girder portions 36 with neither longitudinal ribs nor sub ribs. Also, the longitudinal ribs 40*b* between the inner girder portion 32 and outer girder portions 36 had a constant thickness of 3 mm, whereas the transverse ribs 42*b* and 42*c* had a constant thickness of 4 mm.

The bending strength was measured according to the standard of JIS Z-0602 (1988). Namely, as shown in FIG. 6, the pallet to be measured was mounted on the support tables 50, each having a width of 100 mm, disposed along the side walls 16 of the pallet. On the pallet, the steel round bars 52 were disposed along the fork-inserting holes 44, respectively. A pressure member 54 of a press was disposed on the round bars 52. Then, the press was operated so as to gradually impart a load on the two round bars from 100 kgf to 1,250 kgf. The bending strength is represented by the flexure ratio of the pallet when a load of 1,250 kgf is imparted thereto. The flexure ratio (%) is given by the following formula:

$$[(\delta_2-\delta_1)/l]\times 100$$

in which $\delta_1$ represents a flexure amount at the center portion of the pallet when a load of 100 kgf is imparted; $\delta_2$ represents a flexure amount at the center portion of the pallet when a load of 1,250 kgf is imparted; and l represents a distance between inner surfaces of the support tables 50, 50=900 mm. Accordingly, the bending strength becomes greater as the value of flexure ratio is smaller.

The weights were calculated from the drawings without actual measurement. The total weight of each pallet and the total weight of ribs in each predetermined region in the whole pallet were determined as weights to be compared.

As a result of these measurements concerning bending strength and weights, data shown in the following Table 1 were obtained.

TABLE 1

| | FLEXURE RATIO (%) | TOTAL WEIGHT | RIB WEIGHT IN Sa | RIB WEIGHT IN Sb | RIB WEIGHT IN Sc | RIB WEIGHT IN Sd |
|---|---|---|---|---|---|---|
| PALLET 10 | 1.02 | 16.6 | 0.464 | 0.533 | 0.122 | 0.581 |
| PALLET 10D | 1.06 | 16.3 | 0.464 | 0.533 | 0.122 | 0.581 |
| PALLET 10I | 1.05 | 16.5 | 0.464 | 0.464 | 0.122 | 0.581 |
| PALLET P1 | 1.45 | 16.1 | 0.555 | 0.555 | 0.122 | 0.122 |

As shown in these data, while the weight of each of the pallets 10, 10D and 10I increases by only about 2% to 3% as compared with the pallet P1, their flexure ratio is improved by about 30%, thereby yielding a sufficient bending strength with respect to the whole weight. Accordingly, when pallet is configured such that the peripheral portion of the partition wall 26 of each outer girder portion 36 is particularly reinforced as in the case of the present invention, the pallet can be manufactured with a light weight and a high strength with respect to load.

Here, the pallet 10D has a weight which is about 2% lighter than the pallet 10 due to the drain holes 46 formed therein. Its flexure ratio in the bending test is lower than that of the pallet 10 by only 4%, thereby proving that the effect of the present invention is great.

Figure 12:
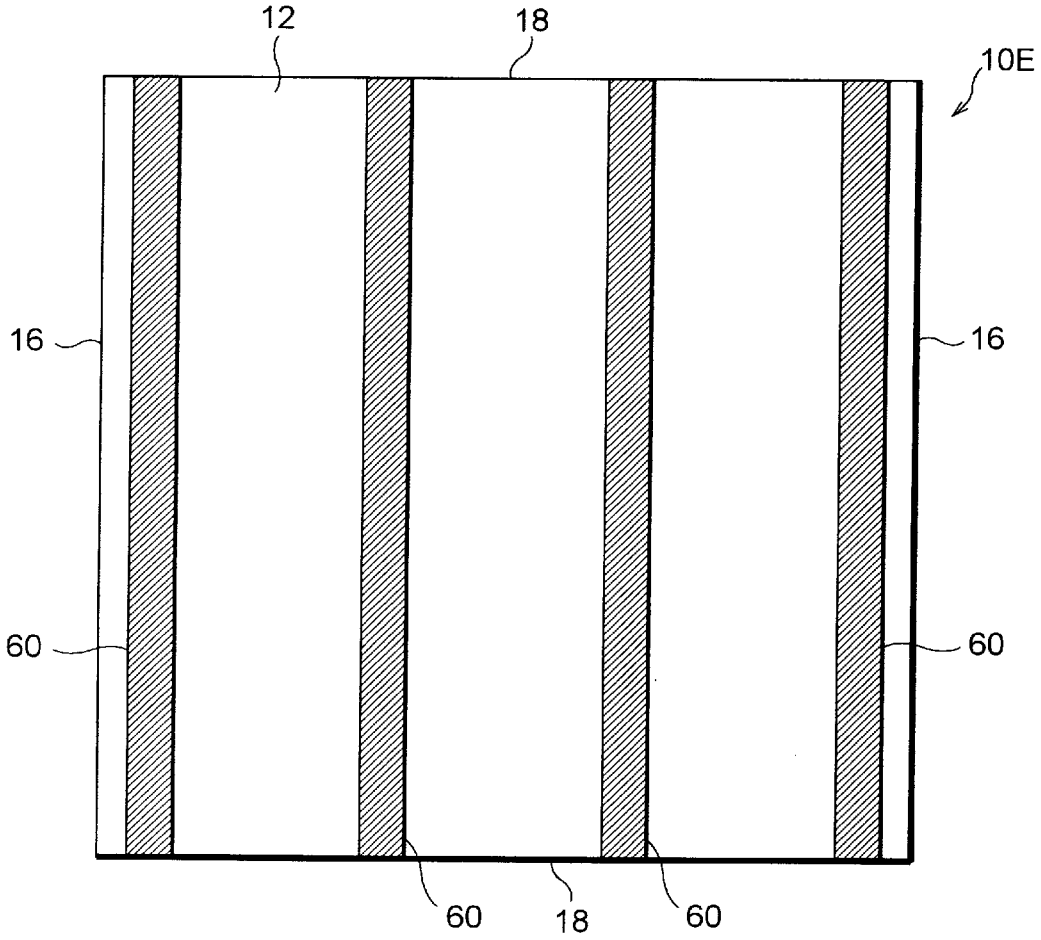
FIG. 12 is a plan view showing a pallet in accordance with a second embodiment of the present invention.
Figure 13:
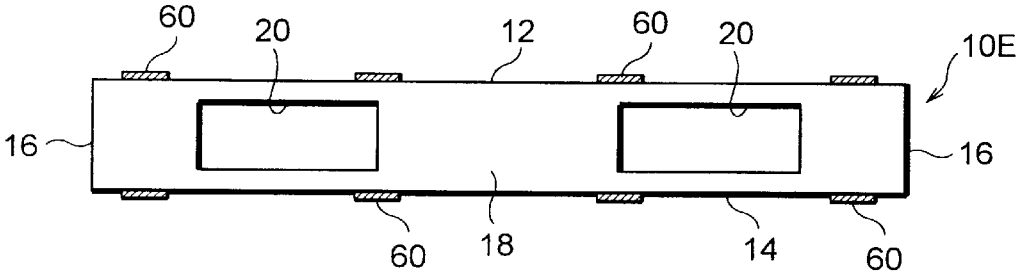
FIG. 13 is a front view of the pallet shown in FIG. 12.

FIGS. 12 and 13 show another embodiment of the present invention. Though configured substantially the same as the pallet 10 shown in FIGS. 1 to 5, a pallet 10E shown in FIGS. 13 and 14 differs therefrom in that nonslip members 60 are attached to the upper surface of the upper board 12 and the lower surface of the lower board 14. The depicted nonslip members 60, each of which is formed like a strip, extend from one side of the pallet 10E to the other side in the same direction. Without being restricted to the strip-like form, the nonslip members 60 may also be formed like a cord, plate, block, disk, or the like.

Also, as depicted, it is preferred that a plurality of the nonslip members 60 (four on each face in the depicted embodiment) be provided. Though not restricted in particular, the size of the nonslip member 60 is, for example, such that its width and thickness are respectively about 10 to 35 mm and about 0.5 to 3 mm.

The nonslip member 60 is constituted by a specific plastic elastomer composition. The thermoplastic elastomer composition used as the nonslip member is a non-crosslinking thermoplastic elastomer composition containing an ethylene-α-olefin copolymer rubber and a polyolefin resin.

Examples of the above-mentioned ethylene-α-olefin copolymer rubber include ethylene-propylene copolymer rubber, ethylene-butene-1 copolymer rubber, ethylene-heptene-1 copolymer rubber, and ethylene-hexene-1 copolymer rubber. Of these materials, ethylene-propylene copolymer rubber is preferable.

Examples of the above-mentioned polyolefin resin include propylene homopolymers; propylene resins such as copolymers of propylene and α-olefins exemplified by propylene-ethylene copolymer, propylene-1-butene copolymer, propylene-1-hexene copolymer, and propylene-4-methyl-1-pentene copolymer; and polybutene. Of these materials, the polypropylene resins are preferable as the above-mentioned polyolefin resin.

In the melted compounding amounts of the two ingredients, the ethylene-α-olefin copolymer rubber is 30 to 90 parts by weight or preferably 50 to 80 parts by weight, whereas the polyolefin resin is 70 to 10 parts by weight or preferably 50 to 20 parts by weight.

When the compounding amount of ethylene-α-olefin copolymer rubber exceeds 90% by weight, the strength of the nonslip members 60 or the bonding strength between the main body of the pallet 10E and the nonslip members 60 may unfavorably deteriorate. On the other hand, when the compounding amount of this rubber is less than 30 parts by weight, nonslip characteristics may not be maintained.

The method of making the non-crosslinking thermoplastic elastomer composition containing the above-mentioned two ingredients is not restricted in particular. For example, known melting and mixing means such as heated roll, Banbury mixer, and extruder can be used. Also, the non-crosslinking thermoplastic elastomer composition may be manufactured by copolymerization.

Further, the non-crosslinking thermoplastic elastomer composition in the present invention may contain a mineral oil type softener. Examples of the softener include paraffinic oils, naphthenic oils, and aromatic oils. Of these oils, the paraffinic oils and naphthenic oils having a favorable compatibility with the ethylene-α-olefin copolymer rubber are preferable.

Also, with respect to 100 parts by weight of the total amount of ethylene-α-olefin copolymer rubber and polyolefin resin, the content of the mineral oil type softener is not more than 100 parts by weight or preferably not more than 50 parts by weight. The ethylene-α-olefin copolymer rubber characteristically exhibits a high extensibility due to the mineral oil type softener. Since the amount of addition of the mineral oil type softener is arbitrarily selected according to the molecular weight of ethylene-α-olefin copolymer rubber employed, it may be used as a material even in the range exceeding the amount mentioned above. Nevertheless, a decrease in strength or bleeding may occur when it is used too much.

The mineral oil type softener may be mixed with the non-crosslinking thermoplastic elastomer composition used in the present invention in a kneader. Alternatively, it may be added as an extender oil to the ethylene-α-olefin copolymer rubber beforehand in the process of making the latter.

Here, in the non-crosslinking thermoplastic elastomer composition, pigments, fillers, stabilizers, ultraviolet absorbers, or other modifying assistants may be used when necessary.

As the method of making the nonslip members 60 from the materials mentioned above, known molding methods such as injection molding method, press molding method, and extrusion molding method may be used. The method of attaching the nonslip members 60 to the main body of the pallet 10E is not restricted in particular. For example, by insert molding method, the nonslip members 60 can be attached to the main body of the pallet simultaneously with the molding of the pallet. Alternatively, by means of bonding, heat fusion, fitting, and the like, they can be attached to the pallet body after the molding of the pallet body.

It has conventionally been known to attach nonslip members to the surface of the pallets. Conventionally known nonslip members are made of a low-density polyethylene-vinyl acetate copolymer (Japanese Patent Publication No.

56-41505) or a partially-crosslinked thermoplastic elastomer (Japanese Patent Publication No. 3-50703). The nonslip member made of a low-density polyethylene-vinyl acetate copolymer, however, has a low bonding strength and friction coefficient with respect to the main body of a pallet made of a synthetic resin such as polypropylene in particular, whereby its effect as a nonslip member may not be sufficient. The nonslip member made of a partially-crosslinked thermoplastic elastomer, on the other hand, may be problematic in that its abrasion resistance is insufficient. The nonslip members 60 made of the above-mentioned non-crosslinking thermoplastic elastomer is free from these problems. Namely, the nonslip member in accordance with this embodiment is inexpensive, maintains its nonslip characteristics over a long period of time, has a high bonding strength with respect to the main body of the pallet, and is excellent in abrasion resistance.

In the following, results of tests concerning slippage of the load, bonding strength, productivity of nonslip members, and abrasion resistance conducted for the pallet 10E in this embodiment will be explained. The results of the tests are shown in the following Table 2. In these tests, the pallet 10F shown in FIGS. 12 and 13 and two kinds of comparative pallets P2 and P3 were prepared.

In order to prepare the main body of the pallet 10E in accordance with this embodiment, halves were made of a polypropylene resin by injection press molding method, and then the halves were joined together by heat fusion. The pallet 10E had a size defined by a width of 1,100 mm, length of 1,100 mm, and height of 144 mm, while the upper and lower boards each had a thickness of 3 mm. The inner configuration of the main body of the pallet was similar to that shown in FIGS. 1 to 5. The strip-like nonslip members 60 made by injection molding of a non-crosslinking thermoplastic elastomer composition were integrally attached to the respective outer surfaces of the upper and lower boards 12 and 14 of the main body of the pallet four by four in the length direction of the pallet. Each nonslip member 60 had a thickness of 2 mm, width of 25 mm, and length of 1,100 mm. Two of the four nonslip members 60 were disposed at positions which were respectively 65 mm inside of both ends of the pallet, while the other two were disposed therebetween, with equal intervals therebetween.

The comparative pallet P2 was the same as the above-mentioned pallet 10E except that a crosslinking thermoplastic elastomer composition was used as the nonslip members. The crosslinking thermoplastic elastomer composition was made by the method comprising the steps of preparing a composition containing 51 parts by weight of ethylene-propylene copolymer rubber, 20 parts by weight of propylene homopolymer, and 29 parts by weight of propylene-ethylene random copolymer; adding 0.04 parts by weight of 2,5-dimethyl-2,5-di(t-butylperoxy)hexane to 100 parts by weight of thus prepared composition; and subjecting thus formed mixture to a dynamic heat treatment for about 30 seconds at 240° to 260° C. by means of a biaxial extruder so as to make it partially crosslinked.

The comparative pallet P3 was the same as the above-mentioned pallet 10E except that ethylene-vinyl acetate copolymer (EVA) is used as the nonslip members. Here, EVA containing 10% by weight of vinyl acetate and having a density of 0.93 g/cm$^3$ was used.

The above-mentioned pallets 10E, P2, and P3 were used for tests concerning the slippage of loads and. bonding strength. For the abrasion test, plates each having a thickness of 3 mm prepared by injection-molding of the compositions identical to the above-mentioned respective nonslip members were used.

Figure 14:
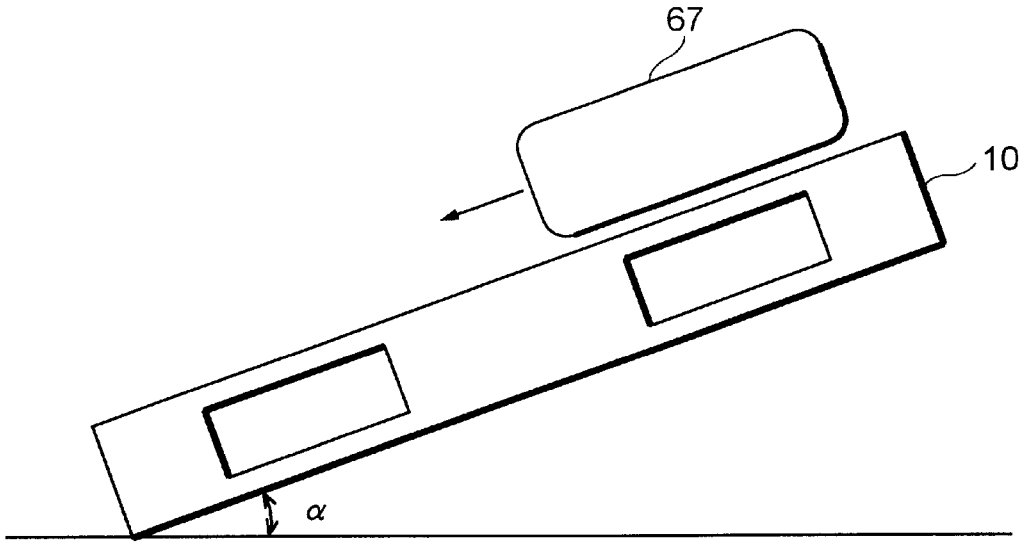
FIG. 14 is an explanatory view showing a method for testing slippage between a load and a pallet.

The load slippage test was performed as follows. Namely, as shown in FIG. 14, a 25-kg resin bag 67 was mounted on each pallet to be evaluated, this pallet was inclined with respect to a horizontal plane, and the state where the resin bag 67 began to slip before the angle of inclination α became 45 degrees was evaluated. The contents of evaluation results indicated in Table 2 are as follows:

○: Hard to slip.

Δ: Slip a little.

In the bonding strength test, evaluated was the resistance to peeling of the nonslip member when the edge portions of the nonslip member were held to impart a force directed so as to peel off the nonslip member attached to the main body of the pallet. The contents of evaluation results indicated in Table 2 are as follows:

○: Hard to peel.

x : Easy to peel.

The contents of evaluation results concerning the productivity of the nonslip member are as follows:

○: Easy to manufacture, incurring a low cost.

Δ: Relatively hard to manufacture, incurring a considerable cost.

For the abrasion test of the nonslip members, the mass of abrasion wear was measured according to JIS K-7204 (1977). For the measurement, Rotary Abrasion Tester (truck wheel: CS-18; load: 1,000 g) manufactured by Toyo Seiki Co., Ltd. was used. The abrasion resistance is better as the mass of abrasion wear is smaller.

TABLE 2

| | SLIPPAGE OF LOAD | BONDING STRENGTH | PRODUCTIVITY | MASS OF ABRASION WEAR (mg) |
|---|---|---|---|---|
| PALLET 10E | ○ | ○ | ○ | 57 |
| PALLET P2 | ○ | ○ | Δ | 200 |
| PALLET P3 | Δ | × | ○ | 55 |

From these test results, it can be seen that the pallet 10E of this embodiment is excellent in nonslip characteristics and yields a high bonding strength between the main body of the pallet and the nonslip members. Also, it has been confirmed that the nonslip member 60 itself is excellent in abrasion resistance and can be manufactured inexpensively.

Figure 15:
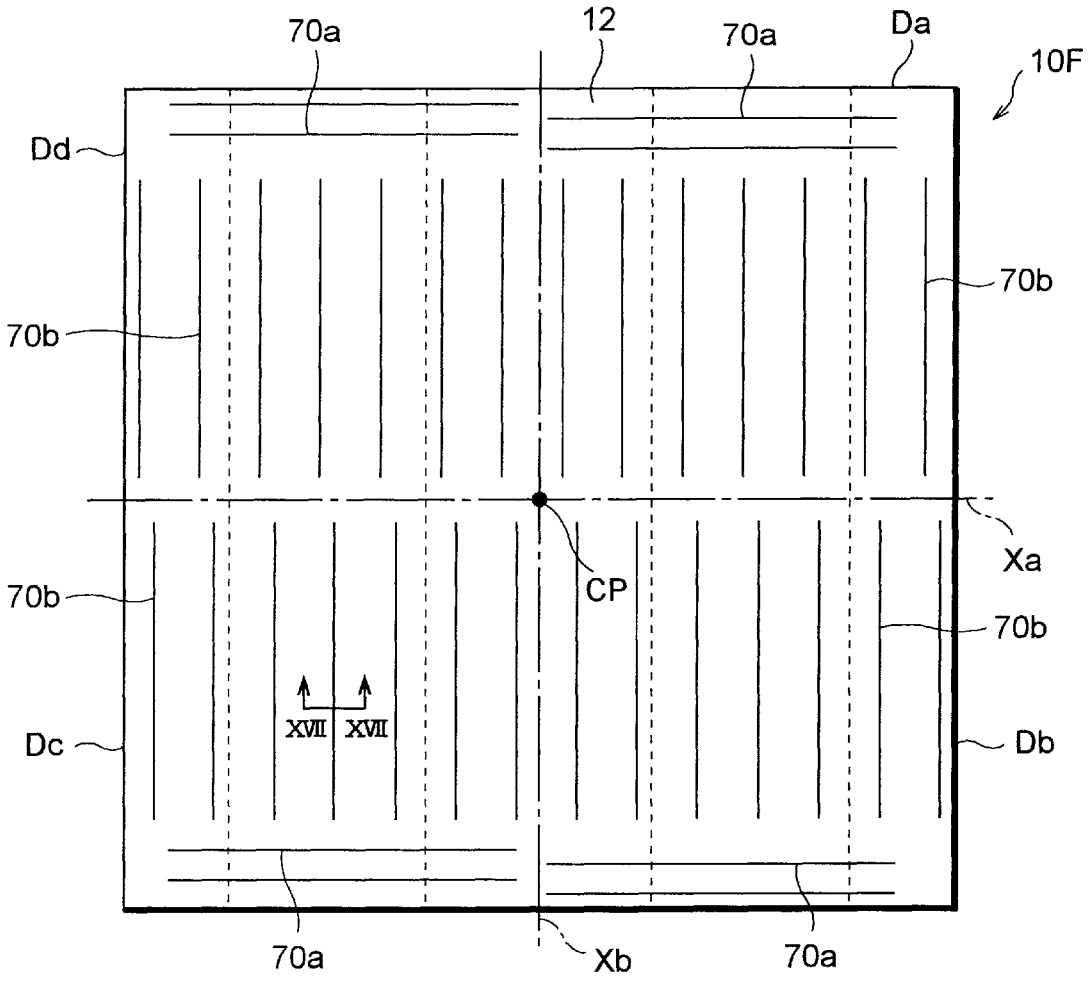
FIG. 15 is a plan view showing a pallet in accordance with a third embodiment of the present invention.

FIG. 15 shows a further embodiment of the present invention. A pallet 10F of FIG. 15 is substantially the same as the pallet 10 shown in FIGS. 1 to 5 except that a plurality of linear projections 70 are monolithically formed on the upper surface of the upper board 12 and the lower surface of the lower board. Each linear projection 70 is made of the material same as that of the upper board 12 and lower board and is monolithically formed with these boards.

Formed in the pallet 10F shown in FIG. 15 are transverse linear projections 70*a* extending in parallel with the side walls 18 having the fork-inserting openings 20 and longitudinal linear projections 70*b* extending in the direction orthogonal thereto. These linear projections 70 are not disposed on two orthogonal center lines Xa and Xb in each of the upper and lower boards 12 and 14 and are asymmetrically arranged to each other with respect to these center lines Xa and Xb interposed therebetween. When the upper board 12 of the pallet 10F is divided into four regions along the two orthogonal center lines Xa and Xb, the arrangement of linear projections 70 in region Da and that in region Dc are symmetrical to each other with respect to a center point CP, whereas the arrangement of linear projections 70 in region Db and that in region Dd are symmetrical to each other with respect to the center point CP. Though not depicted, the arrangement of linear projections in the lower board is similar to that in the upper board 12. Here, it is preferred that the linear projections in the lower board be arranged such that they do not interfere with those in the upper board of another pallet when the former pallet is mounted on the latter pallet. Also, it is preferred that the linear projections 70 be arranged such that they can be used for positioning the pallets 10F when a plurality of the pallets 10F are stacked.

The opening ratio is preferably 20% or less since the layout of linear projections 70 attains a higher degree of freedom thereby. Accordingly, the opening ratio of 0% is the most preferable. The opening ratio refers to the ratio of the total area of the holes and depressions formed in the upper board or lower board to the whole area of the upper board or lower board in the pallet. The opening ratio of 0% means that the upper board or lower board is flat without any hole or depression.

Figure 16:
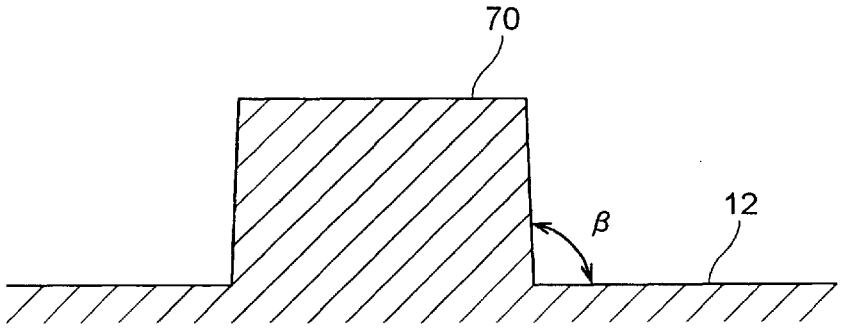
FIG. 16 is an enlarged cross-sectional view taken along XVII—XVII line of FIG. 15, showing a cross-sectional form of a linear projection.
Figure 17:
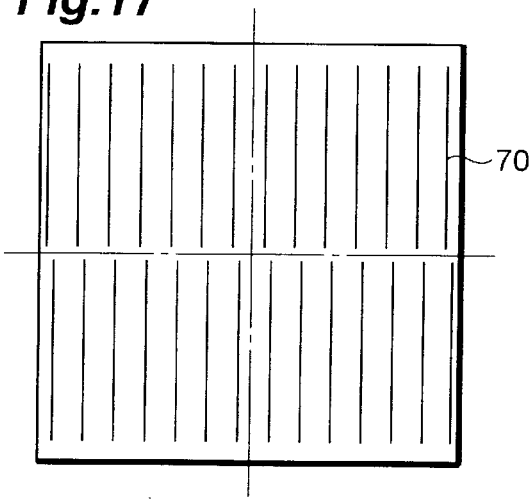
FIGS. 17 to 23 are plan views respectively showing modified examples of the pallet in accordance with the third embodiment.
Figure 20:
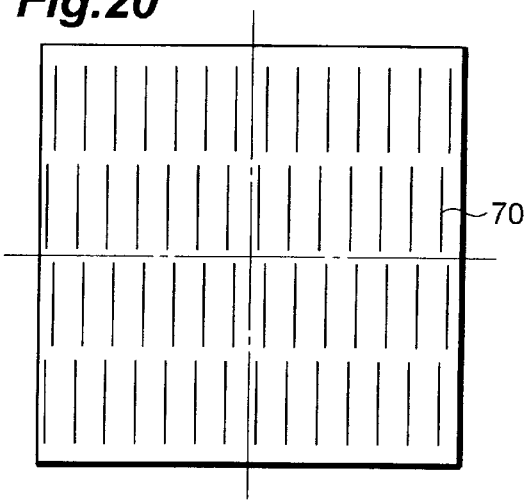
Figure 18:
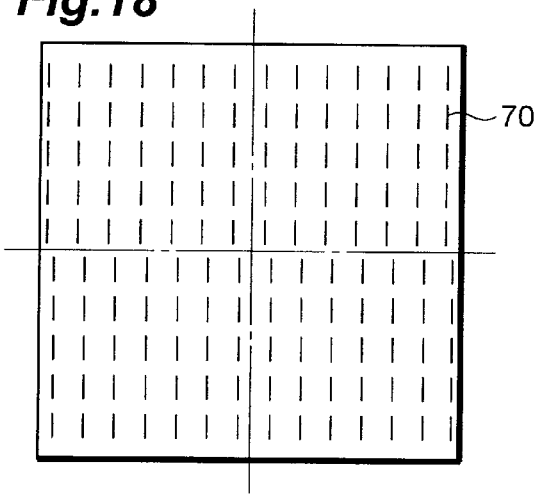

Since each linear projection 70 is used for preventing the slippage between the pallets, its preferable cross-sectional form is substantially rectangular, for example, as shown in FIG. 16. The linear projection 70 shown in FIG. 16 has a trapezoidal form whose width becomes narrower toward the top. Its taper angle β is about 91 to 93 degrees. This trapezoidal form allows the projection 70 to be easily drawn out from a die at the time when the pallet is manufactured.

The height of the linear projection 70 is such that it does not obstruct the loading of objects. For example, it is about 0.8 to 5 mm and preferably 1 to 2 mm. Also, the width, interval, and length of the linear projections 70 are not restricted in particular and can be appropriately selected according to the objects to be loaded. For example, the width is generally 0.5 to 20 mm and preferably 1.5 to 3 mm; the interval is generally 1 to 30 cm and preferably 5 to 10 cm; and the length is generally 5 cm to the width or length of the pallet and preferably 20 cm to not more than ½ of the width or length of the pallet. Also, their number is not restricted to that depicted.

Such a pallet 10F can be easily manufactured by a normal molding method when linear depressions having forms complementary to the linear projections 70 are formed in the die (not depicted) used for molding.

In this configuration, the linear projections 70 on the upper board 12 can prevent the slippage between the pallet 10F and the load thereon. This slippage-preventing effect becomes remarkable especially when a load having a deformable surface, e.g., resin bag, is used. Here, in the state where the pallet 10F is supported by a fork of a forklift, the pallet tends to curve perpendicularly to the inserting direction of the fork, whereby the load may shift along the curved pallet. Accordingly, it is preferred that the number of linear projections 70*b* extending in the fork-inserting direction be greater than the number of linear projections 70*a* perpendicular thereto. When only the nonslip effect for the load is intended, it is unnecessary for the lower surface of the pallet to be provided with linear projections.

When a plurality of pallets 10F are stacked and tilted, the linear projections of one pallet can engage with those on the adjacent surface of the upper or lower pallet, thereby preventing the pallets from transversely shifting.

Further, the linear projections 70 can function as ribs for reinforcing the upper and lower boards.

The arrangement of the linear projections 70 fulfilling these effects is not restricted to that shown in FIG. 15. For example, the arrangements shown in FIGS. 17 to 23 may be adopted.

Figure 21:
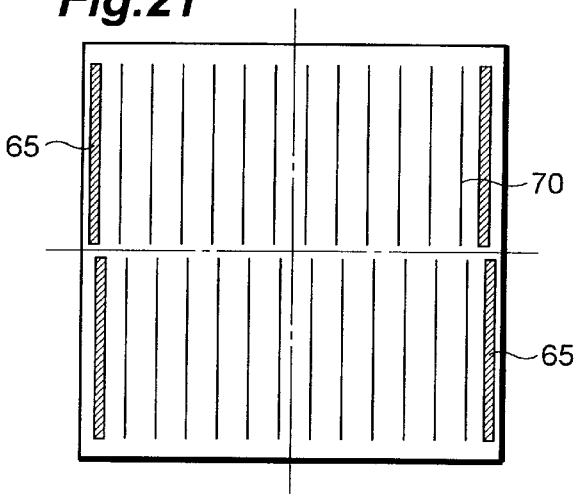
Figure 19:
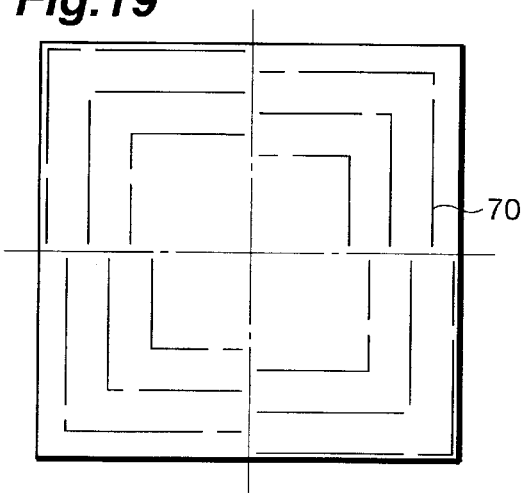
Figure 22:
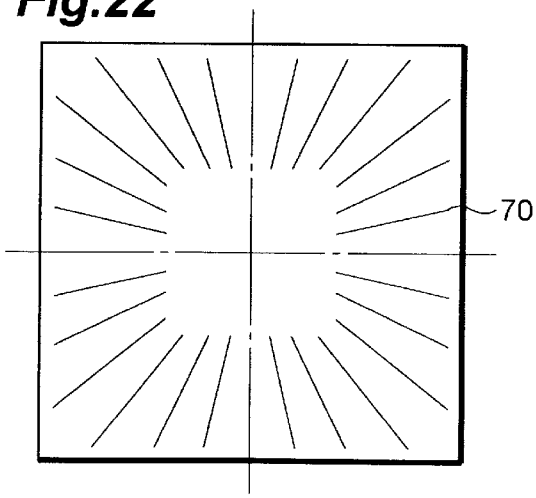
Figure 23:
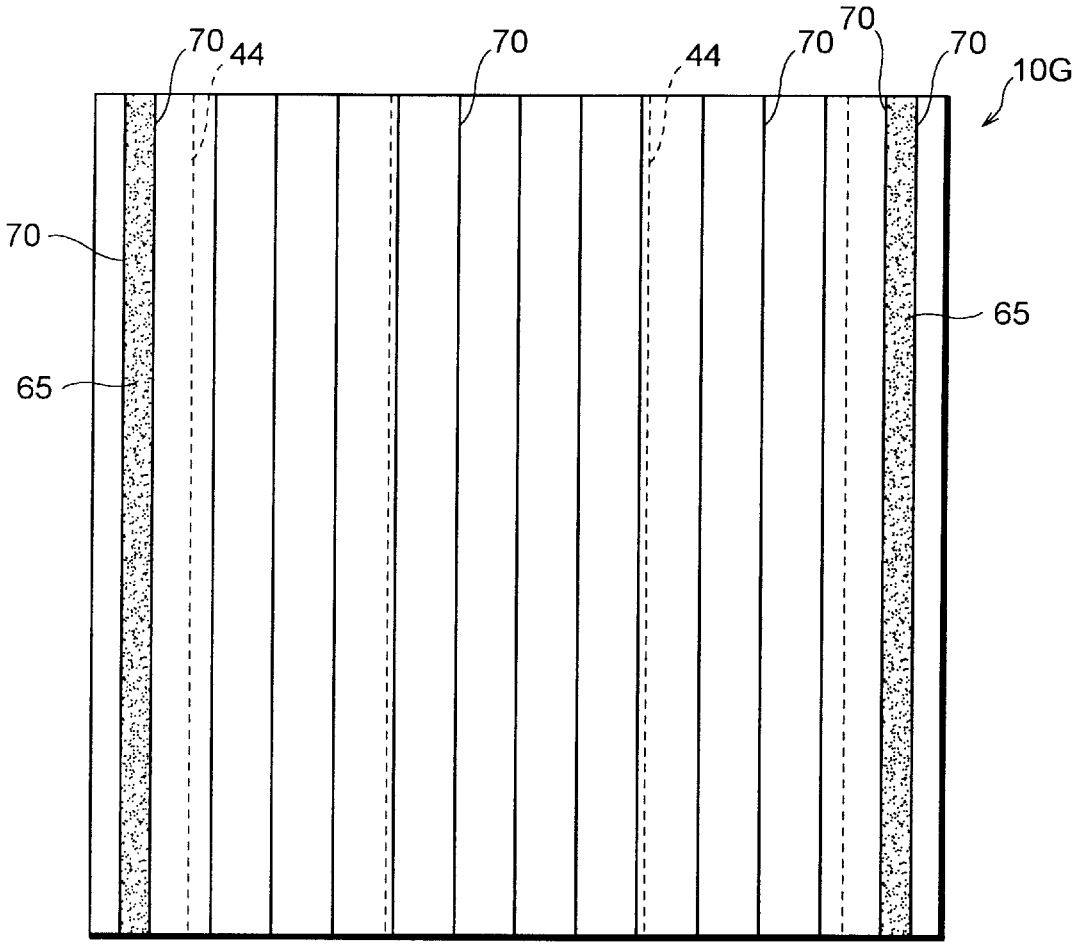

Further, as shown in FIG. 21 or 23, a nonslip member 65 made of a material having a large friction coefficient may be disposed between a pair of linear projections 70 so as to be attached to a pallet surface. While the nonslip member 65 may be made of such materials as rubber, ethylene-vinyl acetate copolymer, and thermoplastic elastomer compositions, non-crosslinking thermoplastic elastomer compositions are preferable as mentioned above in view of the abrasion resistance, bonding strength, nonslip characteristics, and the like. Though each of the nonslip members 65 in FIGS. 21 and 23 is formed like a band or strip, their form is not restricted in particular. Also, their number and positions to be attached can be appropriately selected.

It is preferred that the height or thickness of the nonslip member 65 be greater than the height of the linear projection 70 by about 0.5 to 1 mm.

Here, it is preferable for the strip-like nonslip member 65 to be disposed between the linear projections 70, 70 with small gaps. Where the gaps are small, the edges of the nonslip member 65 cannot be engaged with the load and peeled off.

The method of attaching the nonslip members 65 to the main body of the pallet is not restricted in particular. For example, by insert molding method, the nonslip members 65 can be attached to the main body of the pallet simultaneously with the molding of the pallet. Alternatively, by means of bonding, heat fusion, fitting, and the like, they can be attached to the main body of the pallet after the molding of the latter.

In the following, results of tests concerning slippage of the load, slippage between the pallets, and productivity conducted for the pallet in this embodiment will be explained. The results of the tests are shown in the following Table 3. In these tests, the pallets 10F and 10G respectively shown in FIGS. 15 and 23 and three kinds of comparative pallets P4, P5, and P6 were prepared.

In order to prepare the first pallet 10F configured as shown in FIG. 15, halves were made of a polypropylene resin by injection press molding method, and then the halves were joined together by heat fusion. The pallet 10F had a size defined by a width of 1,100 mm, length of 1,100 mm, and height of 144 mm, while the upper and lower boards each had a thickness of 3 mm. Each of the upper and lower boards of the pallet 10F had no drain holes, and their opening ratio was 0%. The inner configuration of the main body of the pallet was similar to that shown in FIGS. 1 to 5. A plurality of linear projections were monolithically formed with both surfaces of the upper and lower boards so as to extend in parallel with and orthogonal to the fork-inserting direction. Each linear projection had a height of 1 mm and a width of 2 mm. The interval between the linear projections 70*b* disposed in parallel with the fork-inserting direction was 80 mm, while the interval between the linear projections 70*a* disposed orthogonally to the fork-inserting direction was 50 mm. The length of each linear projection 70*b* disposed in parallel with the fork-inserting direction was 400 mm, while the length of each linear projection 70*a* disposed orthogonally to the fork-inserting direction was 500 mm.

The second pallet 10G configured as shown in FIG. 23 was substantially the same as the first pallet 10F except that the linear projections 70 were arranged differently and the nonslip members 65 were attached thereto. The linear projections 70 were formed only along the fork-inserting direction. Here, each of the nonslip members 65 was a strip-like member made of a non-crosslinking thermoplastic elastomer composition. As the non-crosslinking thermoplastic elastomer composition, that containing 60 parts by weight of ethylene-propylene copolymer rubber and 40 parts by weight of propylene-ethylene block copolymer was used. Each nonslip member 65 had a thickness of 2 mm, width of 25 mm, and length of 1,100 mm. Each linear projection 70 had a height of 1 mm and width of 2 mm, while the interval between the linear projections 70 was 80 mm. Exceptionally, the distance between the two outermost linear projections between which the nonslip member 65 was disposed was 25 mm, which coincided with the width of the nonslip member 65.

The comparative pallet P4 was similar to the first pallet 10F except that no linear projections were disposed on the upper and lower boards.

In the comparative pallet P5, five pieces of band-like members made of ethylene-vinyl acetate copolymer were attached as the nonslip members to each of the upper and lower boards of a pallet which had been obtained similarly to the pallet P4. Each nonslip member had a thickness of 2 mm, width of 20 mm, and length of 1,100 mm. The nonslip members were disposed in parallel with the fork-inserting direction, with equal intervals therebetween.

In the comparative pallet P6, a sheet made of ethylene-vinyl acetate copolymer was attached to the whole surface of each of the upper and lower boards of a pallet which had been obtained similarly to the pallet P4. The thickness of the sheet was 2 mm.

The load slippage test was performed as follows. Namely, as shown in FIG. 14, a 25-kg resin bag 67 was mounted on each pallet to be evaluated, and then the state where the resin bag began to slip as the pallet was inclined with respect to a horizontal plane by as much as 45 degrees was evaluated. The contents of evaluation results indicated in Table 3 are as follows:

◎: very hard to slip.

○: Hard to slip.

Δ: Slip a little.

x : Very easy to slip.

Figure 24:
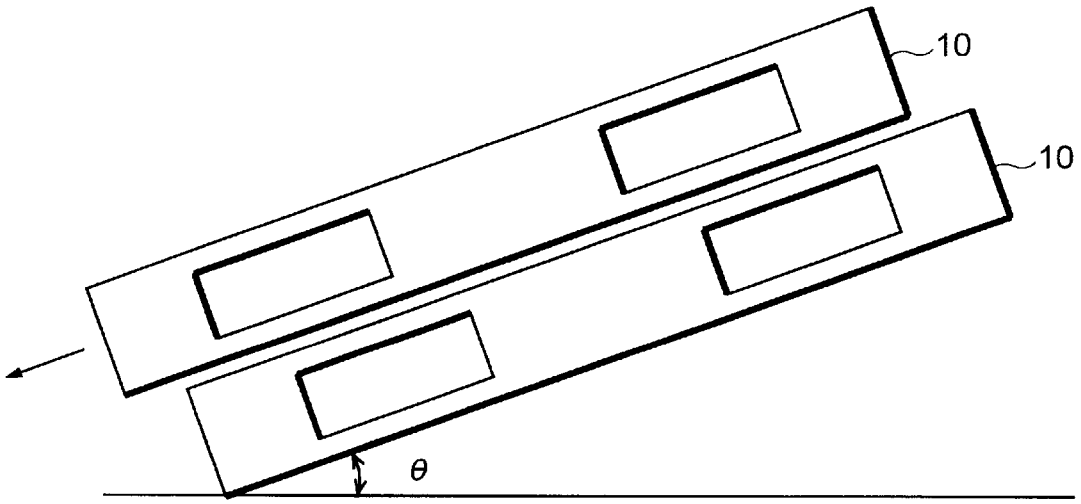
FIG. 24 is an explanatory view showing a method for testing slippage between pallets.

In the test for slippage between pallets, the pallets were stacked as shown in FIG. 24. These pallets were inclined with respect to a horizontal plane, and the state where the upper pallet began to slip before their angle of inclination θ became 45 degrees was evaluated. The contents of evaluation results indicated in Table 3 are as follows:

◎: very hard to slip.

○: Hard to slip.

Δ: Slip a little.

x : Very easy to slip.

The contents of evaluation results concerning the productivity of the nonslip member are as follows:

◎: Very easy to manufacture, incurring a low cost.

○: Easy to manufacture, incurring a low cost.

Δ: Relatively hard to manufacture, incurring a considerable cost.

In view of the above test results, it has been found out that the pallets 10F and 10G of the present invention can inexpensively improve the slippage between the pallet and the load as well as the slippage between the pallets. It has also been found out that the slippage between the pallet and the load can further be improved when a nonslip member made of a material different from the main body of the pallet is used.

TABLE 3

| | SLIPPAGE OF LOAD | SLIPPAGE OF PALLET | PRODUCTIVITY |
|---|---|---|---|
| PALLET 10F | ○ | ◎ | ◎ |
| PALLET 10G | ◎ | ◎ | ○ |
| PALLET P4 | × | × | ◎ |
| PALLET P5 | Δ | Δ | ○ |
| PALLET P6 | ◎ | ○ | Δ |

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims. For example, additional reinforcement ribs may provided on the upper or lower board, or the side or partition walls without departing from the spirit of the present invention.

The basic Japanese Applications No. 8-076004 (076004/1996) filed on Mar. 29, 1996, No. 8-173642 (173642/1996) filed on Jul. 3, 1996, No. 7-334555 (334555/1995) filed on Dec. 22, 1995, and No. 8-024169 (024169/1996) filed on Feb. 9, 1996 are hereby incorporated by reference.

What is claimed is:

1. A plastic pallet comprising:

a pair of generally parallel deck boards;

a pair of outer girder portions respectively disposed at a pair of opposite side portions of said deck boards between said deck boards, each of said outer girder portions including a side wall disposed between associated side edges of said deck boards and a first partition wall disposed between said deck boards generally parallel to and spaced apart from said side wall;

an inner girder portion disposed between said deck boards midway between said outer girder portions, said inner girder portion including a pair of generally parallel second partition walls spaced apart from one another and extending generally parallel to each of said first partition walls; and a plurality of reinforcement ribs disposed on respective inner surfaces of said deck boards;

wherein reinforcement ribs existing in first regions in which said first partition walls are respectively located have a total weight greater than a total weight of reinforcement ribs existing in second regions in which said second partition walls are respectively located, said first and second regions extending generally parallel to said side walls and having substantially the same width, and said first and second regions being generally symmetrical with each other in relation to a center axis extending between an associated first partition wall and an associated second partition wall.

2. A plastic pallet according to claim 1, whereby the first partition wall and portions of the deck boards adjacent to said first partition wall are reinforced more than the second partition wall and portions of the deck boards adjacent to said second partition wall such that flexural strength of said pallet is increased.

3. A plastic pallet according to claim 1, wherein said first region is defined by said first partition wall and a first plane extending generally parallel to said first partition wall and spaced inwardly from said first partition wall, and said second region is defined by said second partition wall and a second plane extending generally parallel to said second partition wall and spaced outwardly from said second partition wall.

4. A plastic pallet according to claim 3, wherein the spacing between said first partition wall and said first plane is approximately one-third of the distance between said first partition wall and an adjacent second partition wall.

5. A plastic pallet according to claim 1, wherein said first region is defined by said first partition wall and a first plane extending generally parallel to said first partition wall and spaced outwardly from said first partition wall, and said second region is defined by said second partition wall and a second plane extending generally parallel to said second partition wall and spaced inwardly from said second partition wall.

6. A plastic pallet according to claim 5, wherein the spacing between said second partition wall and said second plane is approximately one-third of the shorter of the distance between said side wall of the outer girder portion and said first partition wall and the distance between said pair of second partition walls of the inner girder portion.

7. A plastic pallet according to claim 1, wherein said first region is defined by a first inner plane extending generally parallel to said first partition wall and spaced inwardly from said first partition wall by a first distance and a first outer plane extending generally parallel to said first partition wall and spaced outwardly from said first partition wall a second distance, said second region being defined by a plane extending generally parallel to said second partition wall and spaced outwardly from said second partition wall by said first distance and a plane extending generally parallel to said second partition wall and spaced inwardly from said second partition wall by said second distance.

8. A plastic pallet according to claim 7, wherein said first distance is approximately one-third of the distance between said first partition wall and an adjacent second partition wall, and wherein said second distance is approximately one-third of the shorter of the distance between said side wall of the outer girder portion and said first partition wall and the distance between said pair of second partition walls of the inner girder portion.

9. A plastic pallet according to claim 7, wherein the reinforcement ribs existing within the range of the first distance extending inward from said first partition wall have a total weight greater than the total weight of the reinforcement ribs existing within the range of the first distance extending outward from said second partition wall, and wherein the reinforcement ribs existing within the range of the second distance extending outward from said first partition wall have a total weight greater than the total weight of the reinforcement ribs existing within the range of the second distance extending inward from said second partition wall.

10. A plastic pallet according to claim 9, wherein said first distance is approximately ⅓ of a length between said first partition wall and an adjacent second partition wall, and wherein said second distance is approximately ⅓ of the shorter of a length between said side wall of the outer girder portion and said first partition wall and a length between said pair of second partition walls of the inner girder portion.

11. A plastic pallet according to claim 1, wherein said reinforcement ribs include a plurality of longitudinal ribs extending parallel to said side wall and a plurality of transverse ribs extending orthogonally to said longitudinal ribs.

12. A plastic pallet according to claim 11, wherein said transverse ribs disposed between said inner girder portion and outer girder portions have a greater thickness in a region adjacent to said first partition wall than in other regions.

13. A plastic pallet according to claim 11, wherein said transverse ribs disposed between said inner girder portion and outer girder portions have a greater height in a region adjacent to said first partition wall than in other regions.

14. A plastic pallet according to claim 11, wherein a greater number of the transverse ribs are disposed in a region adjacent to said first partition wall than in other regions.

15. A plastic pallet according to claim 11, wherein the transverse ribs in said outer girder portions are respectively aligned with the transverse ribs disposed between said inner girder portion and outer girder portions.

16. A plastic pallet according to claim 1, wherein said reinforcement ribs, side walls, and first and second partition walls have a thickness of about 2 to about 10 mm.

17. A plastic pallet according to claim 1, wherein said deck boards have a thickness of about 2.5 to about 4.5 mm.

18. A plastic pallet according to claim 1, wherein a plurality of drain holes are formed between said inner girder portion and outer girder portions in at least one of said deck boards.

19. A plastic pallet according to claim 1, wherein said pallet is constituted by substantially identical halves molded from a synthetic resin and then are joined together.

20. A plastic pallet according to claim 19, wherein said synthetic resin includes a thermoplastic resin selected from the group consisting of polyethylene resins, polypropylene resins, polyamides, polyethylene terephthalate, acrylonitrile-butadiene-styrene copolymer (ABS), polyvinyl chloride resin, and polycarbonate.

21. A plastic pallet according to claim 1, further comprising a nonslip member provided on an outer surface of at least one of said deck boards, said nonslip member being made of a non-crosslinking thermoplastic elastomer composition containing 30 to 90 parts by weight of an ethylene-α-olefin copolymer rubber and 70 to 10 parts by weight of a polyolefin resin.

22. A plastic pallet according to claim 21, wherein the ethylene-α-olefin copolymer rubber is ethylene-propylene copolymer rubber.

23. A plastic pallet according to claim 21, wherein the polyolefin resin is a polypropylene resin.

24. A plastic pallet according to claim 1, further comprising a plurality of linear projections monolithically formed on an outer surface of at least one of said deck boards.

25. A plastic pallet according to claim 24, wherein said deck board has an opening ratio of 20% or less.

26. A plastic pallet according to claim 24, wherein said linear projections extend parallel to said side wall.

27. A plastic pallet according to claim 24, wherein said linear projections extend orthogonally to said side wall.

28. A plastic pallet according to claim 24, wherein a center line of said deck board is free of said linear projections, said linear projections being disposed asymmetrically with respect to said center line interposed therebetween.

29. A plastic pallet according to claim 24, further comprising a nonslip member disposed between said linear projections.

30. A plastic pallet according to claim 29, wherein said nonslip member is made of a non-crosslinking thermoplastic elastomer composition containing 30 to 90 parts by weight of an ethylene-α-olefin copolymer rubber and 70 to 10 parts by weight of a polyolefin resin.

31. A plastic pallet comprising:

a pair of deck boards disposed in spaced and parallel relation to each other;

a pair of outer girder portions respectively disposed at a pair of opposite side portions of said deck boards and between said deck boards, each of said outer girder portions including a side wall disposed between associated side edges of said deck boards and a first partition wall disposed between said deck boards in spaced and parallel relation to said side wall;

an inner girder portion disposed between said deck boards and located midway between said outer girder portions, said inner girder portion including a pair of second partition walls which are disposed in spaced and parallel relation to each other and in spaced and parallel relation to said first partition wall; and a plurality of reinforcement ribs disposed on respective inner surfaces of said deck boards;

wherein said reinforcement ribs disposed between the adjacent first and second partition walls include longitudinal ribs extending in parallel with said side walls and transverse ribs extending orthogonally to said longitudinal ribs, and wherein portions of said transverse ribs disposed between said first partition wall and said longitudinal rib adjacent to the first partition wall are thicker than the other portions of said transverse ribs.

32. A plastic pallet according to claim 31, wherein the reinforcement ribs disposed in said outer girder portion include a longitudinal rib extending parallel said to side walls and transverse ribs extending between said first partition wall and said longitudinal rib in said outer girder portion, and wherein said transverse ribs in said outer girder portion are respectively aligned with said transverse ribs between said inner girder portion and outer girder portions.

33. A plastic pallet comprising:

a pair of generally parallel deck boards;

a pair of outer girder portions disposed at opposing side portions of said deck boards and extending between said deck boards;

each of said outer girder portions comprising a side wall extending between associated side edges of said deck boards and a first partition wall spaced inwardly from said side wall;

an inner girder portion disposed between said outer girder portions and extending between said deck boards, said inner girder portion comprising a pair of second partition walls spaced apart from one another and spaced inwardly from said first partition walls;

a plurality of reinforcement ribs disposed on inner surfaces of each of said deck boards;

each of said first partition walls being disposed in a respective first rib-containing region and each of said second partition walls being disposed in a respective second rib-containing region, a first portion of said plurality of ribs being disposed in each of said first rib-containing regions, respectively, and a second portion of said plurality of ribs being disposed in each of said second rib-containing regions, respectively, adjacent ones of said first and second rib-containing regions having substantially the same size and being arranged symmetrically with respect to a center line extending between the first and second partition walls associated with the adjacent regions, said plurality of ribs being positioned and configured such that the first portion of ribs disposed in each of said first rib-containing regions have a greater total weight than the second portion of ribs disposed in adjacent second rib-containing regions, thereby providing increased resistance to bending when said pallet is supported beneath said outer girder portions of said deck boards and unsupported beneath the said inner girder portion.

* * * * *